US007316585B2

(12) United States Patent
Smith et al.

(10) Patent No.: US 7,316,585 B2
(45) Date of Patent: Jan. 8, 2008

(54) REDUCING SUCK-OUT INSERTION LOSS

(75) Inventors: Stephen B. Smith, Mechanicsburg, PA (US); Jan De Geest, Wetteren (BE); Stefaan Hendrik Jozef Sercu, Brasschaat (BE)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/626,679

(22) Filed: Jan. 24, 2007

(65) Prior Publication Data

US 2007/0279158 A1 Dec. 6, 2007

Related U.S. Application Data

(60) Provisional application No. 60/809,529, filed on May 30, 2006.

(51) Int. Cl.
*H01R 13/648* (2006.01)

(52) U.S. Cl. ..... 439/608; 439/108

(58) Field of Classification Search ..... 439/608, 439/108, 607, 609, 610, 101
See application file for complete search history.

(56) References Cited

U.S. PATENT DOCUMENTS 5,066,236 A * 11/1991 Broeksteeg ..... 439/79
5,342,211 A * 8/1994 Broeksteeg ..... 439/108
5,982,249 A 11/1999 Bruns ..... 333/1
6,280,209 B1 8/2001 Bassler et al. ..... 439/101
6,652,318 B1 11/2003 Winings et al. ..... 439/608
6,843,687 B2 * 1/2005 McGowan et al. ..... 439/608
6,918,789 B2 * 7/2005 Lang et al. ..... 439/608
7,160,151 B1 * 1/2007 Rigby et al. ..... 439/607
2001/0008189 A1 7/2001 Reede ..... 174/116
2005/0101166 A1 5/2005 Kameyama ..... 439/79
2006/0183377 A1 * 8/2006 Sinsheimer ..... 439/608

OTHER PUBLICATIONS

Ahn, D. et al., "A Design if the Low-Pass Filter Using the Novel Microstrip Defected Ground Structure", *IEEE Transactions on Microwave Theory and Techniques*, 2001, 49(1), 86-93.

(Continued)

*Primary Examiner*—Gary F. Paumen
(74) *Attorney, Agent, or Firm*—Woodcock Washburn LLP

(57) ABSTRACT

An electrical connector including a lead frame assembly of a first dielectric material that includes a pocket filled with a second dielectric material. A first ground reference, which may be either a ground contact or conductor or a virtual ground defined between signal contacts of a differential signal pair, extends in the first dielectric material and has a first physical length. A second ground reference having a different physical length than the first length extends in the first dielectric material and also through the pocket. The combination of the length of the second ground reference through the pocket along with the difference in the dielectric constants associated with the first and second dielectric materials, provides for equalizing or matching the electrical lengths of these two references having different physical lengths. This may aid in reducing slot-line mode of a co-planar waveguide. The cross-sectional size of the second reference within the pocket may be altered to provide uniform impedance along the length of the second reference as well as an impedance matched to the first conductor.

20 Claims, 27 Drawing Sheets

OTHER PUBLICATIONS

Chen, E. et al., "Characteristics of Coplanar Transmission Lines on Multilayer Substrates: Modeling and Experiments", *IEEE Transactions on Microwave Theory and Techniques*, Jun. 1997, 45(6), 939-945.

Cheng, H-J. et al., "Terahertz-Bandwidth Characteristics of Coplanar Transmission Lines on Low Permittivity Substrates", *IEEE Transactions on Microwave Theory and Techniques*, 1994, 42(12), 2399-2406.

Chua, L.H. et al., "Broadband Characterisation of CPW Transition and Transmission Line Parameters for Small Reflection Up to 100 GHZ", *RF and Microwave Conference*, 2004, 269-271.

Hettak, K. et al., "Simultaneous Realization of Millimeter Wave Uniplanar Shunt Stubs and DC Block", *IEEE MTT-S Digest*, 1998, 809-812.

Lee, M-Y. et al., "Characteristic of the Coplanar Waveguide to Microstrip Right-Angled Transition", Department of Electronics Engineering, 3 pages.

Leung, L.L.W. et al., "Low-Loss Coplanar Waveguides Interconnects on Low-Resistivity Silicon Substrate", *IEEE Transactions on Components and Packaging Technologies*, 2004, 27(3), 507-512.

Lim, J-S. et al., "A Spiral-Shaped Defected Ground Structure for Coplanar Waveguide", *IEEE Microwave and Wireless Components Letters*, 2002, 12(9), 330-332.

Mao M-H. et al., "Characterization of Coplanar Waveguide Open End Capacitance-Theory and Experiment", *IEEE Transactions on Microwave Theory and Techniques*, 1994, 42(6), 1016-1024.

Macháč, J. et al., "Space Leakage of Power from Uniplanar Transmission Lines", *Czech Technical University*, 565-568.

Möttönen, V.S. et al., "Novel Wide-Band Coplanar Waveguide-to-Rectangular Waveguide Transition", *IEEE Transactions on Microwave Theory and Techniques*, 2004, 52(8), 1836-1842.

Soliman, E.A. et al., "Multimodel Characterization of Planar Microwave Structures", *IEEE Transactions on Microwave Theory and Techniques*, 2004, 52(1), 175-182.

Son, J-H. et al. "Picosecond Pulse Propagation on Coplanar Striplines Fabricated on Lossy Semiconductor Substrates: Modeling and Experiments", *IEEE Transactions on Microwave Theory and Techniques*, 1993, 41(9), 1574-1580.

Suh, Y-H. et al., "Coplanar Stripline Resonators Modeling and Applications to Filters", *IEEE Transactions on Microwave Theory and Techniques*, 2002, 50(5), 1289-1296.

Tzuang, C-K. C. et al., "Leaky Mode Perspective on Printed Antenna", *Proc. Natl. Sci. Counc. ROC(A)*, 1999, 23(4), 544-549.

Williams, D.F. et al., "Accurate Transmission Line Characterization", *IEEE Microwave and Guided Wave Letters*, 1993, 3(8), 247-249.

Weller, T.M. et al., "High Performance Microshield Line Components", *IEEE Transactions on Microwave Theory and Techniques*, 1995, 43(3), 534-543.

Ya. A. Kolmakov, et al., "Microstrip and Slotline Two-Pole Microwave Filters with Additional Transmission Zeros", *Int. Crimean Conference, Microwave & Telecommunication Technology*, 2004, 405-407 (English Abstract provided).

Wu, M-D. et al., "Full-Wave Characterization of the Mode Conversion in a Coplanar Waveguide Right-Angled Bend", *IEEE Transactions on Microwave Theory and Techniques*, 1995, 43(11), 2532-2538.

* cited by examiner

--- Original
— Improved

REDUCING SUCK-OUT INSERTION LOSS

CROSS-REFERENCE TO RELATED APPLICATIONS

This application claims priority under 35 U.S.C. § 119 (e) to U.S. provisional application Ser. No. 60/809,529, filed on May 30, 2006, entitled "Reducing Suck-Out Insertion Loss," which is herein incorporated by reference in its entirety.

BACKGROUND

An electrical connector may include a co-planar wave guide structure. A coplanar waveguide structure may be a structure in which ground conductors are within a plane defined by conductors of the structure. That is, some ground and signal conductors within the connector may be coplanar. A cross section of contacts as they would appear arranged in a coplanar wave guide structure is depicted in FIG. 1. Ground conductors G1, G2 may be located adjacent to a single-ended signal conductor S. In such an arrangement, the voltage on the ground G1 may be identical to the voltage on the ground G2 at the same point along the length of the conductors. That is, there may be no potential difference between the ground conductor G1 and the ground conductor G2. Thus, if a voltage is applied to the signal conductor S, its potential difference with reference to G1 may be the same as its potential difference with reference to G2 at any point along its length.

If the conductors bend within a connector, such as in a right-angle connector, the voltages on the ground conductors G1, G2 may become out of sync with respect to one another. With reference to FIG. 2, for example, the voltages of the ground conductors G1, G2 at location A may be identical. At location B, where the contacts bend, however, the voltages of the ground conductors G1, G2 may be different. This may cause electrical current in the ground conductors G1, G2 that are not transverse electro-magnetic currents. Such electric currents may cause a "slot-line mode" traveling along a "slot" SL or space between the signal conductor S and one or both of the ground conductors G1, G2. The slot line mode may decrease the energy of the transverse electro-magnetic mode at certain frequencies, and result in increasing the insertion loss of the transverse electro-magnetic mode at the certain frequencies. Additionally, coupling of the signals of the conductor S to the ground conductor G1 that has the larger physical length compared to the ground conductor G2 may also cause an increase in insertion loss.

SUMMARY

The present invention generally relates to electrical connectors that operate above a 1 to 2 Gigabit/sec data rate, and preferably above 10 Gigabit/sec, such as at 250 to 30 picosecond rise times. Crosstalk between differential signal pairs may be generally six percent or less. Impedance may about 100±10 Ohms. Alternatively, impedance may be about 85±10 Ohms. There are preferably no shields between differential signal pairs. Air or plastic can be used as a dielectric material. Column pitch may be about 1.5 mm, less than 1.5 mm, or more than 1.5 mm, such as 1 to 3 mm or more.

An electrical connector may have reduced slot-line mode in its co-planar wave guide structure by matching electrical distances of two or more ground references in the structure. The structure may include a first dielectric material and a first ground reference extending a first reference length in the first dielectric material. The first reference length combined in part with the first dielectric material may define a first electrical length.

A second ground reference in the waveguide structure may extend a second reference length that is different from the first reference length. The electrical length of the second ground reference may be matched to that of the first electrical length by creating a pocket in the first dielectric material and filling the pocket with a second dielectric material having a different dielectric constant than the first dielectric material. A portion of the second ground reference may extend through the pocket, and a combination of the first and second dielectric materials as well as the physical length of the second ground reference may define a second electrical length matched to the first electrical length.

Uniform impedance of the differential signal conductors and the ground may be maintained by increasing the size of the portion of the ground reference extending through the pocket with respect to the size of the rest of the second ground reference. That is, in cross-section, the area of the second ground reference in the pocket may be larger than the area, in cross section, of the second ground reference that is contained in the first dielectric material. In general, one aspect of the present invention is the equalization of ground skew.

Structuring of the dielectric material of the lead frame housing may also result in a modification of the electromagnetic coupling between the signal leads and the ground leads. This may reduce insertion loss of an electrical connector, particularly when electrical lengths are matched. When an air pocket or window is defined by the lead frame housing, the signal or ground contact that passes through the pocket or window can be width-adjusted to retain a desired impedance.

DETAILED DESCRIPTION

Figure 2:
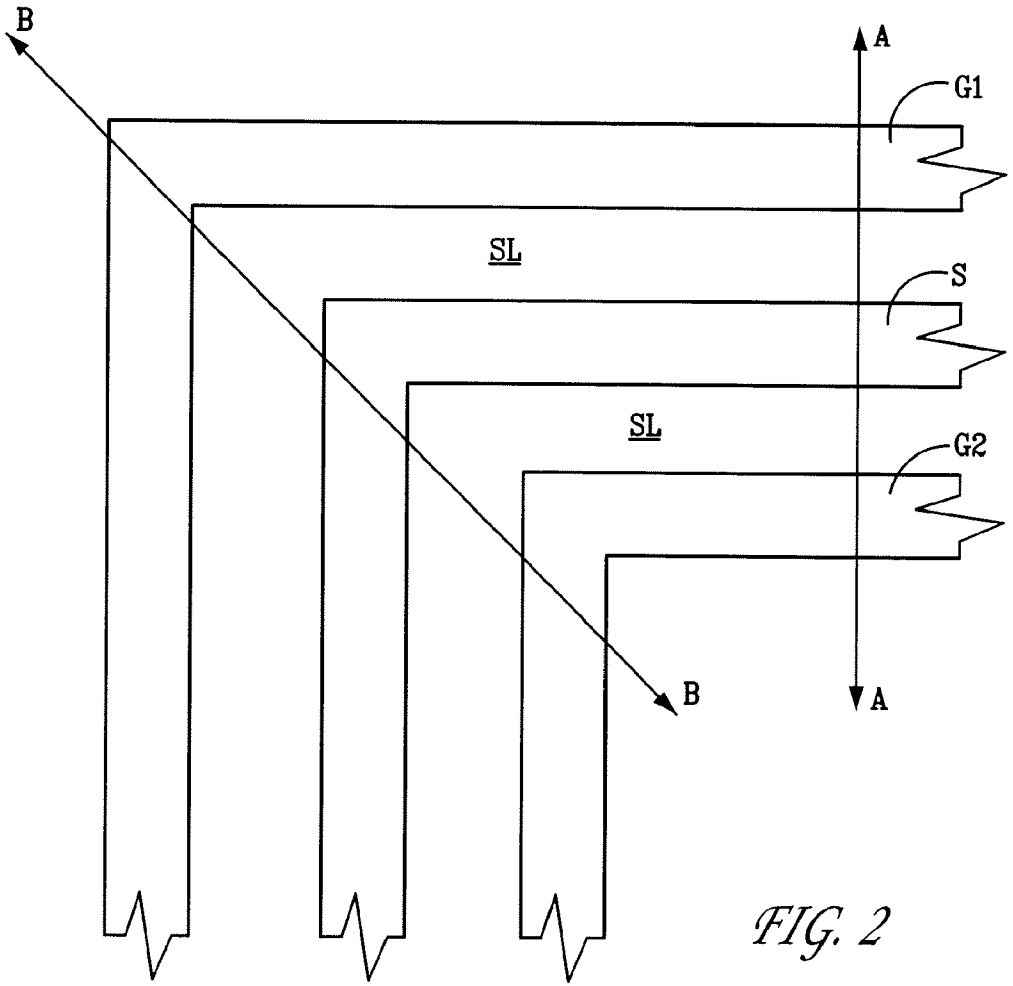
FIG. 2 is a partial, cut-away, side view of electrical conductors in a co-planar waveguide of an example right angle electrical connector.
Figure 1:
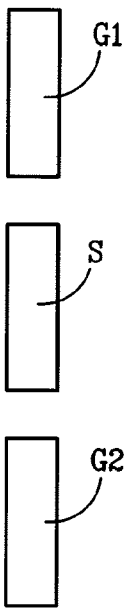
FIG. 1 is a cross sectional view of contacts as they would appear arranged in a coplanar wave guide structure.
Figure 3:
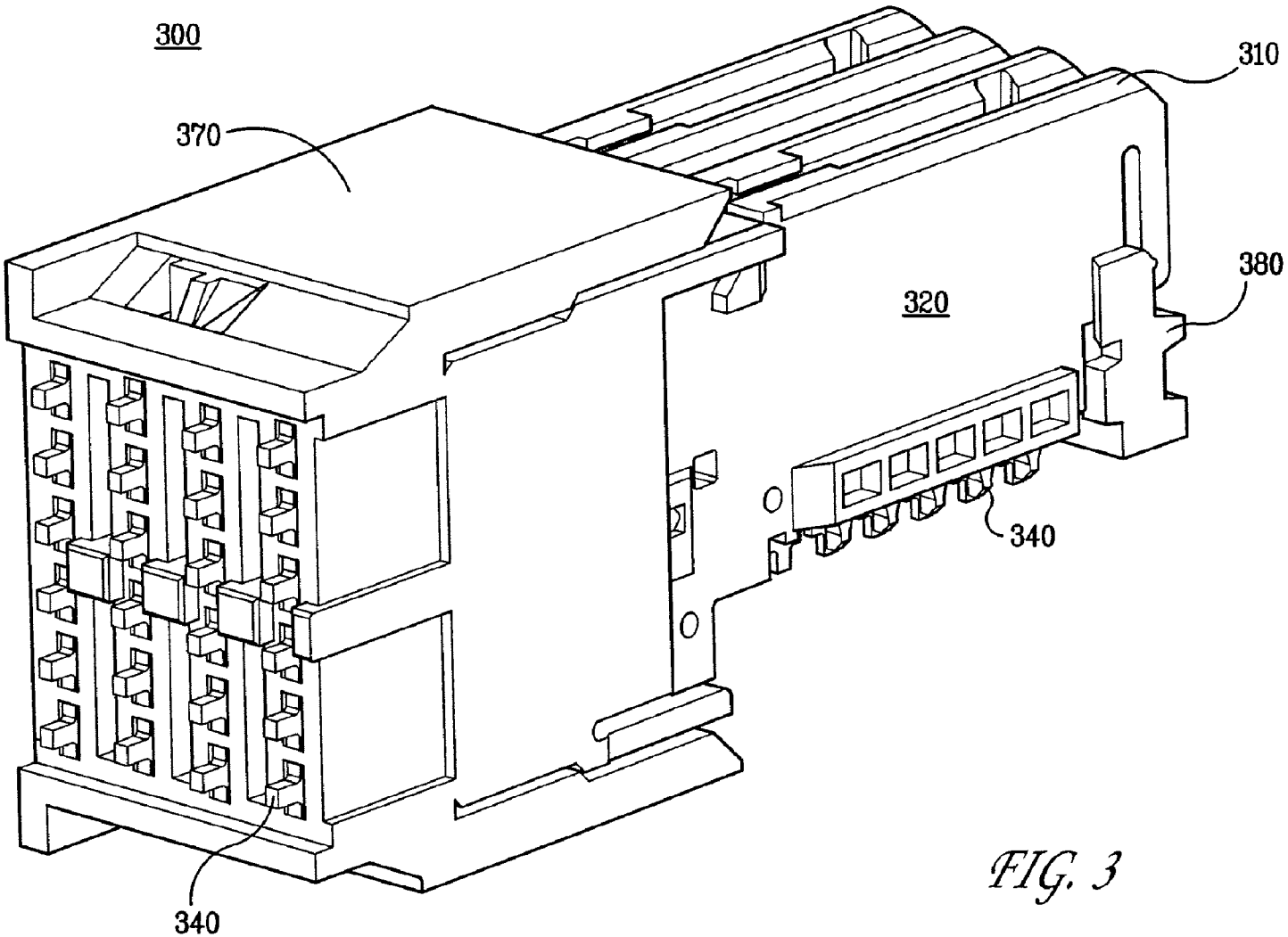
FIG. 3 is a perspective view of an example right angle connector.

FIG. 3 is a perspective view of an example right angle connector 300 that includes several linear arrays of electrical contacts. The connector 300 could include just one array or several arrays arranged in rows or columns. While embodiments are described with regard to right angle connectors, other embodiments may be implemented in other types of connectors as well. Such other connectors may include electrical contacts forming a co-planar waveguide structure where the contacts extend different physical lengths within a first dielectric material.

The connector 300 may operate above a 1 to 2 Gigabit/sec data rate (about 250 picosecond rise time), such as 3, 4, 5, 6, 7, 8, 9 and 10 Gigabits/sec and preferably above 10 Gigabits/sec, such as at a 30-picosecond rise time. Worst case, multi-active crosstalk between six or more driven differential signal pairs on a victim pair closest to the six or more driven differential signal pairs may be generally six percent or less. Impedance may about 100±10 Ohms, 85±10 Ohms, or some other system impedance. There are preferably no shields between differential signal pairs. Air or plastic can be used as a dielectric material. Column pitch is about 1.5 mm, or less than 1.5 mm, or more than 1.5 mm, such as 1, 1.1, 1.2, 1.3, 1.4, 1.6, 1.7, 1.8, 1.9, 2.0, 2.1, 2.2, 2.3, 2.4, 2.5, 2.6, 2.7, 2.8, 2.9, and 3.0 mm or more. Tightly electrically edge-coupled or broadside coupled contact arrangements can be used.

The connector 300 may include lead frame assemblies 310. The lead frame assemblies 310 may include a lead frame housing 320 as well as ground and signal contacts 340. The contacts 340 may bend within the lead frame housing 320 such that the connector 300 may connect a first substrate to a second substrate that is perpendicular or at a right angle to the first substrate. The lead frame assemblies 310 may be secured within a housing 370 and may be retained in the connector 300 by a retaining member 380.

The lead frame housing 320 may aid in containing contacts of a lead frame assembly 310 in an orientation such that the lead frame housing 320 aids in preventing movement of the contacts 340 relative to one another within the lead frame housing 320. The example lead frame housing 320 may abut a large portion of the contacts 340 as the contacts 340 extend through the lead frame assembly 310. In alternative embodiments, a lead frame housing may form a frame around contacts such that, for example, portions of the contacts within the lead frame housing may be visible. The lead frame housing 320 may be made of a dielectric material such as plastic having a dielectric constant.

Figure 4B:
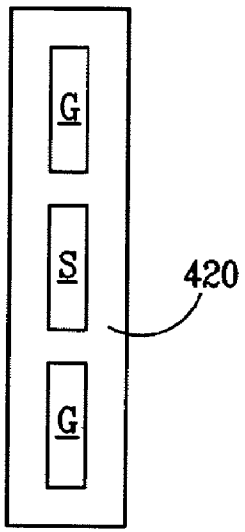
FIG. 4B is a cross-sectional view of an example lead frame assembly taken along line AA of FIG. 4A.
Figure 4A:
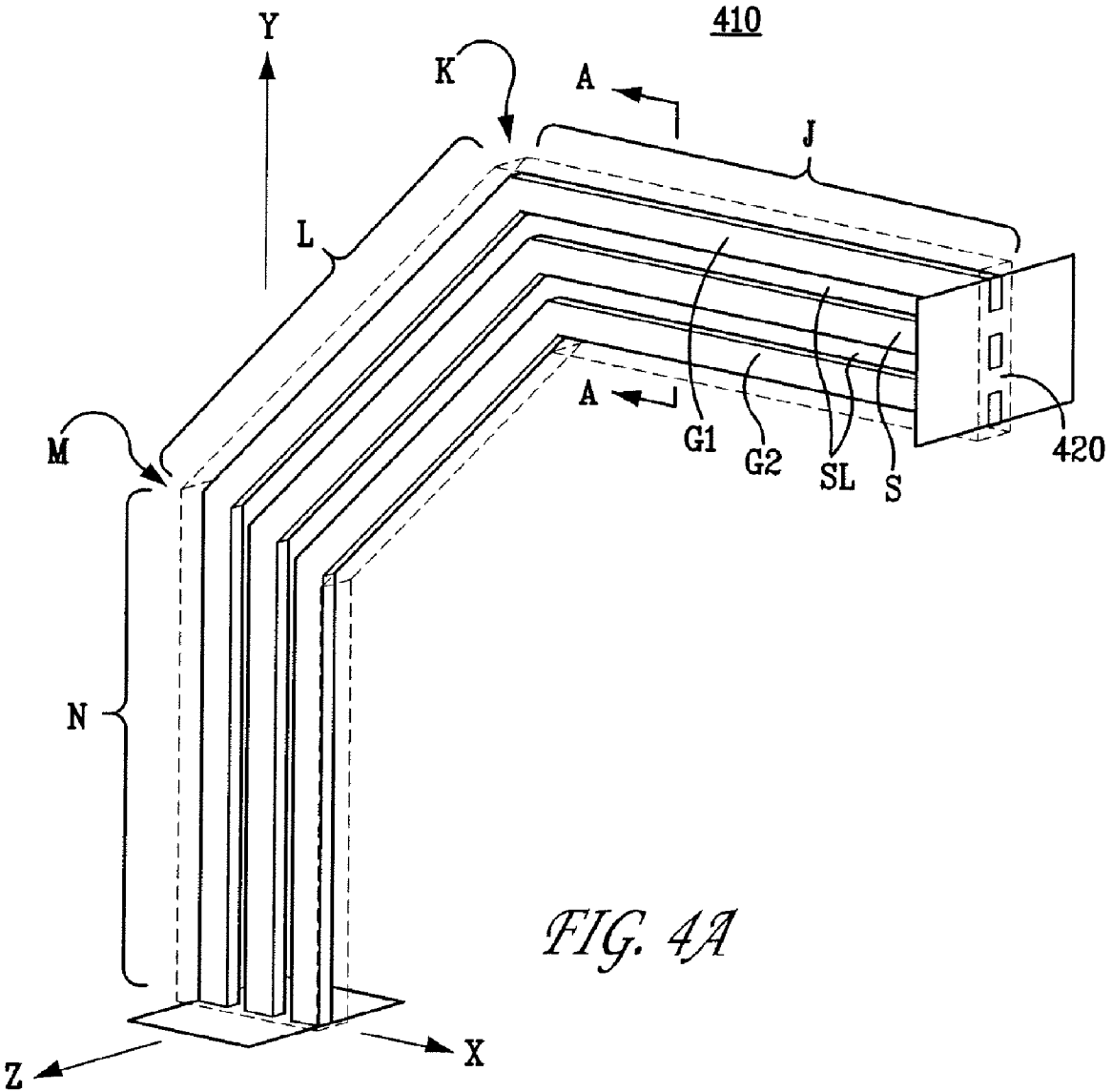
FIG. 4A is a perspective view of an example lead frame assembly.

FIG. 4A is a perspective view of a portion of a lead frame assembly 410. FIG. 4B is a cross section view of the lead frame assembly 410 taken along line AA shown in FIG. 4A. The portion of the lead frame assembly 410 may be included in a connector such as the connector 300 described in FIG. 3. That is, the portion 410 may be used in a right-angle connector to connect perpendicular substrates. The perspective view in FIG. 4A shows contacts G1, G2, S extending in a lead frame housing 420. The distal ends of the contacts G1, G2, S and the edges of the lead frame housing 420 may not be shown for purposes of clarity.

The lead frame assembly 410 may include a single-ended signal conductor S and ground contacts G1, G2. The signal conductor S and ground contacts G1, G2 may be encapsulated in a dielectric material of the lead frame housing 420. That is, the lead frame housing 420 may be plastic that encapsulates the contacts G1, G2, S. Alternatively, the lead frame housing 420 may encase a dielectric material such as air, and the contacts G1, G2, S may be surrounded by the air. In still other alternative embodiments, air may surround the contacts G1, G2, S within an electrical connector. That is, the contacts G1, G2, S may be surrounded by air within an electrical connector such as the connector 300 without being encapsulated within a lead frame housing such as the lead frame housing 420. Such contacts may be secured in the connector at distal ends or, alternatively, plastic or a second dielectric material may abut the contacts at points along their lengths to aid in supporting them.

In FIG. 4A, the contacts S, G1, G2 are shown as if encapsulated in a clear lead frame housing 420; however, the lead frame housing 420 may be opaque. The contacts S, G1, G2 may be coplanar. That is, the contacts S, G1, G2 may lie in a plane defined by arrows X and Y. While only three contacts S, G1, G2 are shown in FIG. 4A, it should be understood that the lead frame assembly 410 may include more contacts such as more contacts within the XY plane.

The portion of the lead frame assembly 410 may include segments J, L, and N. The segment J, for example, may extend in a direction indicated by the arrow X. The segment N may extend in a direction indicated by the arrow Y. The Y direction may be perpendicular to the X direction. Between the J and N segments may be the segment L. The segment L may form a 45° angle with the segment J at a location K. The segment L may form a 45° angle with the segment N at a location M. Of course, alternative right-angle and non-right-angle configurations are envisioned.

The conductors G1, G2, S each may have a uniform shape in cross section for their length through the portion 410. The conductors G1, G2, S may be sized and shaped in cross section such that the impedance is matched along the physical length of the conductors G1, G2, S. The impedance may be matched because gaps between the conductors may remain constant along the respective lengths. Thus, each of the conductors G1, G2, S in combination with the housing 420 may define a uniform impedance along their length.

Voltages on the ground conductors G1, G2, however, may be different in the vicinity of the locations K, M. This may cause electrical currents in the ground conductors G1, G2 that are not transverse electro-magnetic currents. Such electric currents may cause a slot-line mode traveling along a slot between the signal conductor S and one or both of the ground conductors G1, G2. The slot-line mode may cause an increase in the insertion loss of the transverse electromagnetic mode, particularly at certain frequencies. As used herein, the term "insertion loss" includes a ratio of near-end and far-end signal strength such that an insertion loss of 1 indicates that the near-end and far-end signal strengths are equal. In other words, an insertion loss of 0 dB indicates that the near-end and far-end signal strengths are equal. Such a slot-line mode may be caused, in a co-planar wave guide structure, because the physical length of the conductor G1 may be longer than the physical length of the conductor G2. This may occur whether signal conductors carry single-ended or differential signals. If one of the certain frequencies affected by the slot-line mode is a frequency at which the connector or the structure operates, then the slot-line mode may impede maximum performance of the connector.

Figure 5:
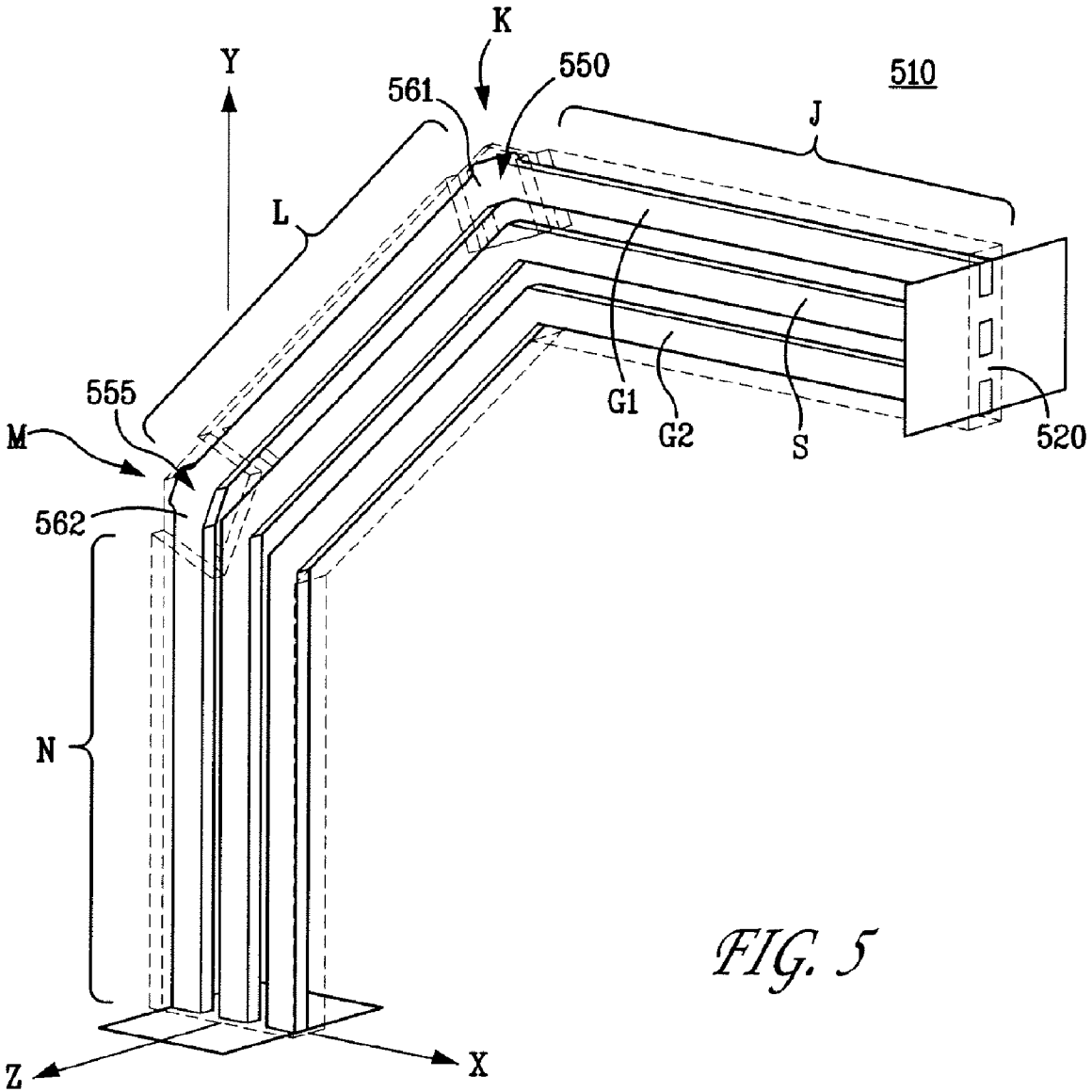
FIG. 5 is a perspective view of an example lead frame assembly with pockets.

FIG. 5 is a perspective view of a portion of a lead frame assembly 510. The portion 510 may include ground contacts G1, G2 and a single-ended signal contact S located between the ground conductors G1, G2. The contacts S, G1, G2 may be coplanar. That is, the contacts S, G1, G2 may lie in a plane defined by arrows X and Y. While only three contacts S, G1, G2 are shown in FIG. 5, it should be understood that a lead frame assembly may include more contacts including more contacts within the XY plane. The perspective view in FIG. 5 shows contacts G1, G2, S extending in a lead frame housing 520. The distal ends of the contacts G1, G2, S and the edges of the lead frame housing 520 are not shown for purposes of clarity.

The signal conductor S and ground conductors G1, G2 may be encapsulated in a dielectric material of a lead frame housing 520. That is, the lead frame housing 520 may be, for example, plastic that encapsulates the contacts G1, G2, S. Alternatively, the lead frame housing 520, as well as all other embodiments described herein, may encase a dielectric material such as air, and the contacts G1, G2, S may be surrounded by the air. In still other alternative embodiments, air may surround the contacts G1, G2, S within an electrical connector. That is, the contacts G1, G2, S may be surrounded by air within an electrical connector such as the connector 300 without being encapsulated within a lead frame housing such as the lead frame housing 520. Such contacts may be secured in the connector at distal ends or, alternatively, plastic or a second dielectric material may abut the contacts at points along their lengths to aid in supporting them.

In FIG. 5, the contacts S, G1, G2 are shown as if encapsulated in a clear lead frame housing 520; however, the lead frame housing 520 may be opaque. The portion of the lead frame assembly 510 may include segments J, L, and N. The segment J, for example, may extend in a direction indicated by the arrow X. The segment N may extend in a direction indicated by the arrow Y. The Y direction may be perpendicular to the X direction. Between the J and N segments may be the segment L. The segment L may form a 45° angle with the segment J. The segment L may form a 45° angle with the segment N. The conductors G1, G2, S may likewise bend in the vicinity of locations K, M to form right angle conductors.

The conductor G1 may be physically longer than the conductors S, G2. The conductor S may be physically longer than the conductor G2. While the physical length of the conductor G1 is longer than the conductor G2, the electrical length of the conductor G1 may be matched to the conductor G2. As used herein, the term "electrical length" or "electrical distance" of a conductor, such as the conductors G1, G2, is the conductor's physical length multiplied by the ratio of (a) the propagation time of an electrical or electromagnetic signal through a medium such as a dielectric material to (b) the propagation time of an electromagnetic wave in free space over a distance equal to the physical length of the medium in question.

A first pocket 550 may be formed in the lead frame housing 520 in the vicinity of a location K where the conductor G1 is bent at a 45° angle. A second pocket 555 may be formed in the vicinity of a location M where the conductor G1 is again bent at a 45° angle. The pockets 550, 555 may be formed in the lead frame housing 520 such that some of the lead frame housing 520 abuts the ground conductor G1 in the vicinity of locations K, M. The pockets 550, 555 may be filled with a second dielectric material that is different than the dielectric material of the lead frame housing 520. For example, the pockets 550, 555 may be filled with air or another dielectric material having a dielectric constant that is different than the dielectric constant of the material of the lead frame housing 520.

If the dielectric constant of the material within one or both pockets 550, 555 is less than the dielectric constant of the lead frame housing 520, the speed associated with "signals" of the ground conductor G1 around the bend in the vicinity of locations K, M may be increased such that the electrical distance of the ground conductor G1 may be matched to the ground conductor G2. As used herein, the terms "match," "matched," or "matching" refers to obtaining an electrical distance of one reference that, within a predefined, acceptable or reasonable margin, is equalized with respect to one or more other references. Such a predefined, acceptable, or reasonable margin may be 1-20%, with the commercially acceptable standard generally being 10% or less. It is understood that, because of variables associated with electrical properties in a connector, obtaining exactly equal electrical distances may be difficult, though of course, the terms "match," "matched," or "matching" also include "equal."

Equalizing the speed in the vicinity of the bends of conductor G1 may aid in equalizing the voltages through the bends. In this way, the decrease in the dielectric constant through the bends at locations K, M may aid in matching the electrical length of the longer conductor G1 to the conductor G2. Therefore, by forming pockets 550, 555 around the bends in the vicinity of the locations K, M, the electrical length of the physically longer conductor G1 may be shortened to match the electrical length of the physically shorter conductor G2. In this way, a ratio of the electrical lengths of the conductor G1 to the conductor G2 may be less than a ratio of the physical lengths or reference lengths of the conductor G1 to the conductor G2.

The matching of the electrical lengths may be adjusted by adjusting the size of the pockets 550, 555 or by the dielectric material filling the pockets 550, 555. For example, the pockets 550, 555 may be sized such that a portion of the signal conductor S abuts the second dielectric material filling the pockets 550, 555.

It should be recognized, that the size of the pockets 550, 555 may not be the same as each other. Additionally, it should be recognized that alternative embodiments are envisioned where a pocket is formed at a right-angle bend of a ground conductor instead of including two pockets at respective 45° bends. Other embodiments include other angled bends and pockets formed at one or more of such bends. In still other embodiments, the pockets may be formed along straight portions of conductors (i.e., not at the bends or in addition to pockets formed at the bends). Alternative embodiments may be incorporated into other connectors where a slot-line mode otherwise may be created, and also may be incorporated in non-right-angle connectors.

It is noted that reducing the dielectric constant of the lead frame housing 520 in the pockets 550, 555 may affect the uniformity of the impedance of the conductors S and G1, G2 over the length of the conductors S and G1, G2. That is, while matching the electrical length of the conductor G1 with the conductor G2 by introducing a second dielectric in the vicinity of the locations K, M, the change of dielectric constant in the vicinity of the locations K, M may alter the otherwise uniform impedance of the conductors S, G1, G2.

In the example embodiment of FIG. 5, filling the pockets 550, 555 with a dielectric constant lower than the lead frame housing 520 may increase the impedance of the conductors S, and G1, G2. Therefore, to promote uniformity of impedance along the conductors the size, in cross-section, of the conductor G1 in one or both pockets 550, 555 may be increased relative to the size of the remainder of the conductor G1. As shown in FIG. 5, within the pockets 550, 555, the conductor G1 includes additional conductive portions 561, 562. Such additional conductive portions 561, 561 promote uniformity of impedance along the length of the conductor G1. In summary, therefore, the pockets 550, 555 aid in matching the electrical distance of the conductor G1 with that of the conductor G2, and the enlarged size of the conductor G1 within the pockets 550, 555 aids in maintain a matched or uniform impedance within the portion of the lead frame assembly 510. The signal conductors can also be increased or decreased in size to maintain a matched or uniform impedance. As used herein, the terms "match," "matched," or "matching" with regard to impedance refers to obtaining an impedance that is as close as possible to the impedance of the system that drives the signals. Thus, for example, an impedance of about 110 to 90 ohms is "matched" to system impedance of 100 ohms. An impedance delta of 10% is an acceptable match in an 85 ohm system.

It should be recognized that, in alternative embodiments, a pocket may be formed in the lead frame housing 520 around the conductor G2 in the vicinity of the locations K and M. A dielectric material having a dielectric constant higher than the remainder of the lead frame housing may be placed in the pocket. This may increase the electrical length of the ground conductor G2 to match it to the physically longer ground conductor G1. Thus, using a dielectric material with a greater dielectric constant on the short conductor G2 may be an alternative to using a dielectric material with a lesser dielectric constant on the longer conductor G1. Such a concept is of course equally applicable to all other example embodiments described herein.

Figure 6:
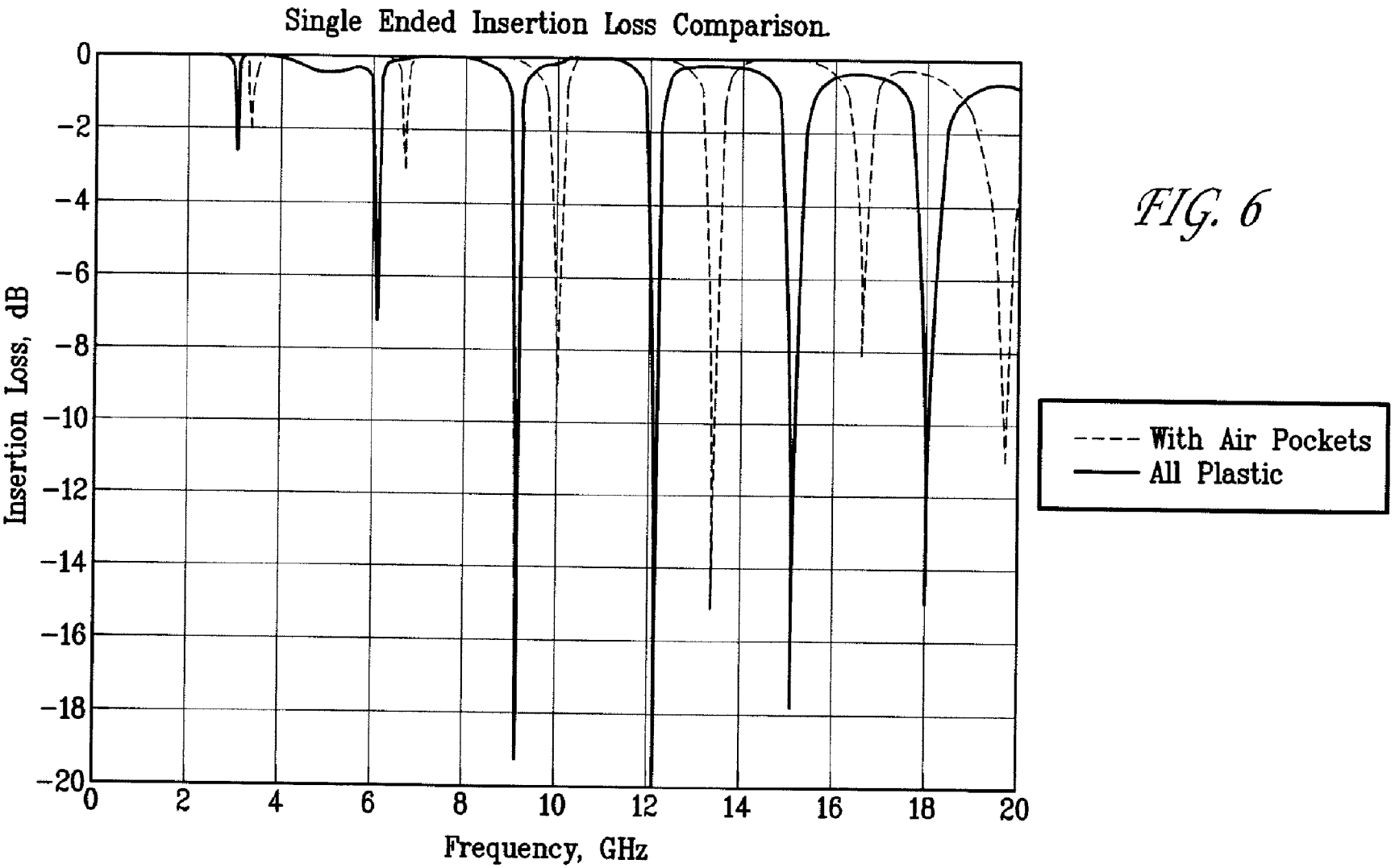
FIG. 6 is a graphical depiction for comparing insertion loss associated with the example lead frame assembly of FIG. 4 to the example lead frame assembly of FIG. 5.

FIG. 6 is a graphical depiction 600 comparing insertion loss associated with, for example, the lead frame assembly 400 of FIG. 4 to the lead frame assembly 500 of FIG. 5. The insertion loss associated with the partial lead frame assembly 400 of FIG. 4 is shown as a solid line. The insertion loss associated with the portion of the lead frame assembly 500 is shown as a dashed line. Generally, the graphical depiction 600 shows that the insertion loss associated with the lead frame assembly 500 is less than that associated with the lead frame assembly 400. For example, the insertion loss between approximately 6 and 7 GHz is over −7 dB for the assembly 400 and about −3 dB for the assembly 500. The insertion loss between approximately 9 and 10 GHz is about −19 dB for the assembly 400 and about −10 dB for the assembly 500. The insertion loss around 16 GHz is approximately −18 dB for the assembly 400 and −8 dB for the assembly 500.

Figure 7:
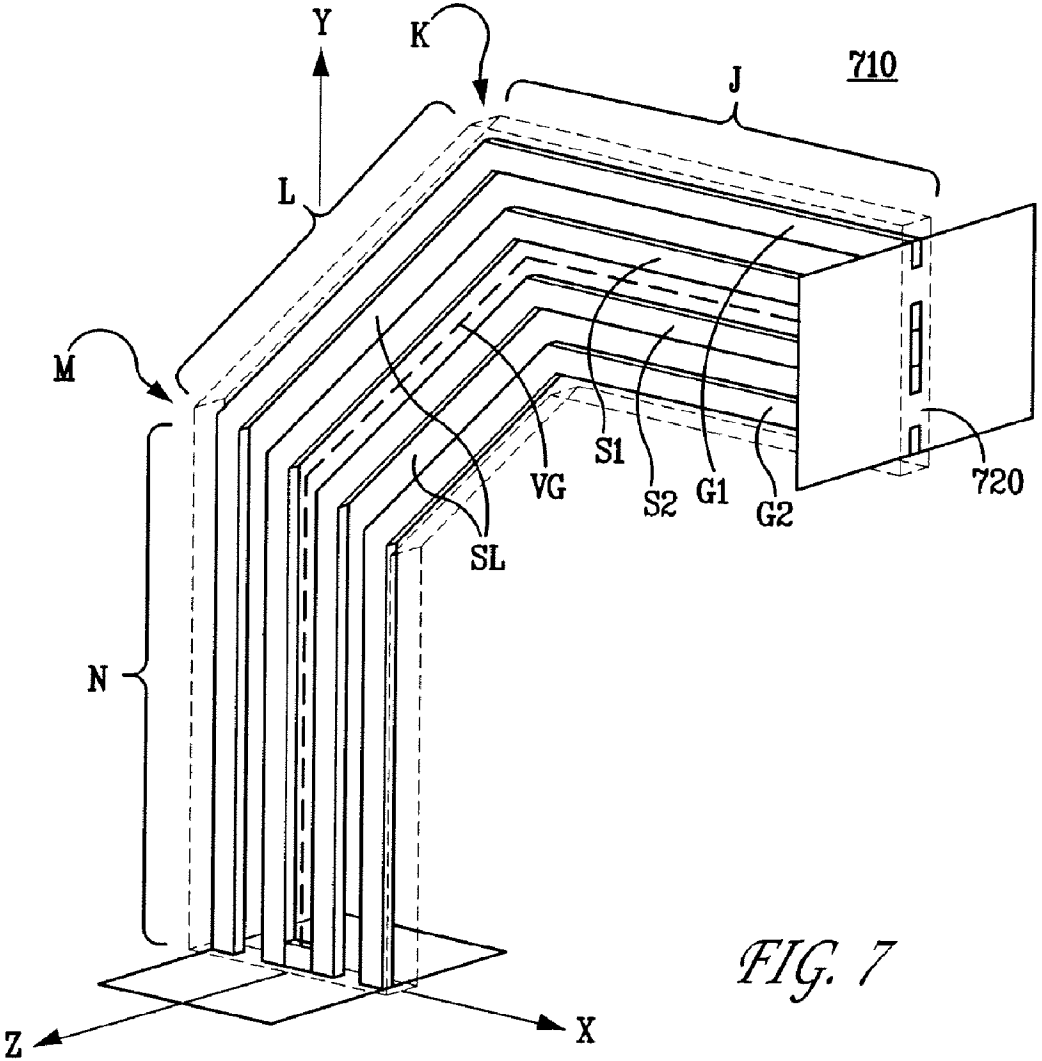
FIG. 7 is a perspective view of an example lead frame assembly.

FIG. 7 is a perspective partial view of a lead frame assembly 710. The lead frame assembly 710 may include ground conductors G1, G2, and signal conductors S1, S2. The signal contacts S1, S2 may form a differential signal pair. The lead frame assembly 710 may be included in a connector such as the connector 300 described in FIG. 3. The lead frame assembly 710 may be used in a right-angle connector to connect perpendicular substrates. The perspective view in FIG. 7 shows contacts G1, G2, S1, S2 extending in a lead frame housing 720. The distal ends of the contacts G1, G2, S1, S2 and the edges of the lead frame housing 720 may not be shown for purposes of clarity.

The signal conductors S1, S2 and ground conductors G1, G2 may be encapsulated in a dielectric material of a lead frame housing 720. That is, the lead frame housing 720 may be plastic that encapsulates the contacts G1, G2, S1, S2. Alternatively, the lead frame housing 720 may encase a dielectric material such as air, and the contacts G1, G2, S1, S2 may be surrounded by the air. In still other alternative embodiments, air may surround the contacts G1, G2, S1, S2 within an electrical connector. That is, the contacts G1, G2, S1, S2 may be surrounded by air within an electrical connector such as the connector 300 without being encapsulated within a lead frame housing such as the lead frame housing 720. In FIG. 7, the contacts S1, S2, G1, G2 are shown as if encapsulated in a clear lead frame housing 720; however, the lead frame housing 720 may be opaque.

The contacts S1, S2, G1, G2 may be coplanar. That is, the contacts S1, S2, G1, G2 may lie in a plane defined by arrows X and Y. While only four contacts S1, S2, G1, G2 are shown in FIG. 7, it should be understood that a lead frame assembly may include more contacts such as within the XY plane.

The lead frame assembly 710 may include segments J, L, and N. The segment J, for example, may extend in a direction indicated by the arrow X. The segment N may extend in a direction indicated by the arrow Y. The Y direction may be perpendicular to the X direction. Between the J and N segments may be the segment L. The segment L may form a 45° angle with the segment J at a location K. The segment L may form a 45° angle with the segment N at a location M.

The conductors G1, G2, S1, S2 each may have a uniform shape in cross section for its length through the lead frame housing 720. The conductors G1, G2, S1, S2 may be sized and shaped in cross section such that the impedance is matched along the physical length of the conductors G1, G2, S1, S2. The impedance may be matched because a gap between the conductors may remain constant along the respective lengths. Thus, each of the conductors G1, G2, S1, S2 in combination with the housing 720 may define a uniform impedance along its length as well as be matched to the impedance defined by the other conductors G1, G2, S1, S2.

The signal conductors S1, S2 may form a differential signal pair and may define a virtual ground VG located approximately midway between the signal conductors S1, S2. The virtual ground VG is represented by a dotted line in FIG. 7. The virtual ground VG may be located within the same XY plane as the lead frame assembly 720 and may extend midway between the signal conductors S1, S2 for the length of the conductors S1, S2 within the lead frame assembly 710.

A voltage on the ground conductor G1 may be different from a voltage of the virtual ground VG in the vicinity of the locations K and M. This may cause electrical current in the ground conductor G1 and ground reference VG that are not transverse electro-magnetic currents. Such electric currents may cause a slot-line mode traveling along a slot SL or space, between the signal conductors S1, S2 and respective adjacent ground conductors G1, G2. Such a slot-line mode may be caused because the physical length of the conductor G1 may be longer than the length of the virtual ground VG reference.

Figure 8:
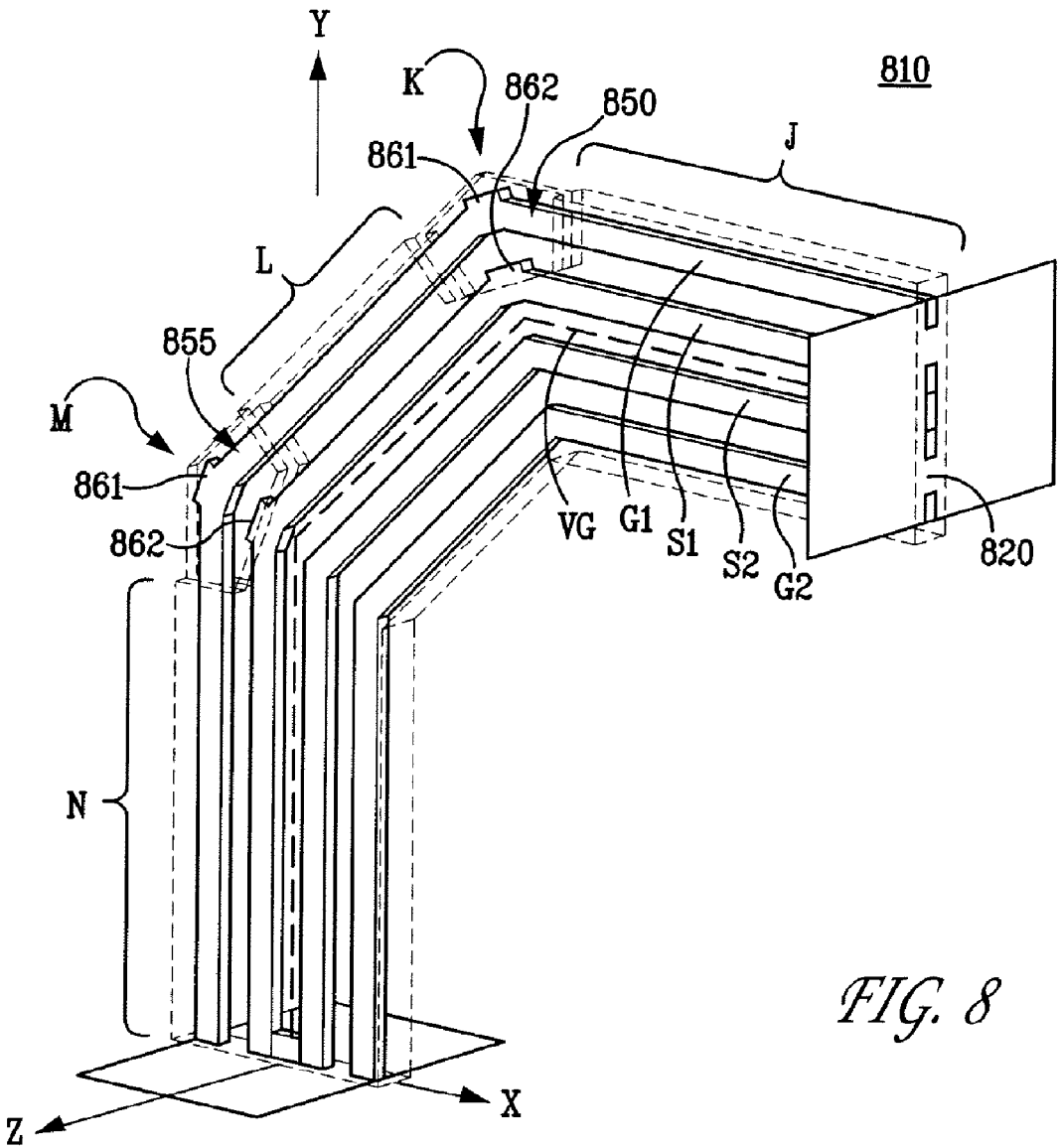
FIG. 8 is a perspective view of an example lead frame assembly with pockets.

FIG. 8 is a partial perspective view of a lead frame assembly 810. The lead frame assembly 810 may include ground conductors G1, G2 and signal conductors S1, S2. The signal conductors S1, S2 may form a differential signal pair and may define a virtual ground reference VG midway between them. The virtual ground VG is denoted in FIG. 8 by a dotted line. The contacts S1, S2, G1, G2, as well as the virtual ground VG, may lie in a plane defined by arrows X and Y. The perspective view in FIG. 8 shows contacts G1, G2, S1, S2 extending in a lead frame housing 820. The distal ends of the contacts G1, G2, S1, S2 and the edges of the lead frame housing 820 may not be shown for purposes of clarity.

The signal conductor S1, S2 and ground conductors G1, G2 may be encapsulated in a dielectric material of the lead frame housing 820. That is, the lead frame housing 820 may be, for example, plastic that encapsulates the contacts G1, G2, S1, S2, as well as the virtual ground VG. In FIG. 8, the contacts S1, S2, G1, G2 are shown as if encapsulated in a clear lead frame housing 820; however, the lead frame housing 820 may be opaque.

The lead frame assembly 810 may include segments J, L, and N. The segment J, for example, may extend in a direction indicated by the arrow X. The segment N may extend in a direction indicated by the arrow Y. The Y direction may be perpendicular to the X direction. Between the J and N segments may be the segment L. The segment L may be at a 45° angle with the segment J. The segment L may be at a 45° angle with the segment N. The conductors G1, G2, S1, S2, as well as the virtual ground VG, may likewise bend in the vicinity of locations K, M to form right angle conductors.

The conductor G1 may be physically longer than the conductors S1, S2 G2, as well as the virtual ground VG. While the physical length of the conductor G1 may be longer than the virtual ground VG, the electrical length of the conductor G1 may be matched to the virtual ground VG. A first pocket 850 may be formed in the lead frame housing 820 in the vicinity of the location K where the conductor G1 is bent at a 45° angle. A second pocket 855 may be formed in the vicinity of the location M where the conductor G1 is bent at a 45° angle. The pockets 850, 855 may be formed in the lead frame housing 820 such that some of the lead frame housing 820 abuts the ground conductor G1 in the vicinity of locations K, M. The pockets 850, 855 may be filled with a second dielectric material that is different than the dielectric material of the lead frame housing 820. For example, the pockets 850, 855 may be filled with air or another dielectric material that includes a dielectric constant that is less than the dielectric constant of the material of the lead frame housing 820.

By reducing the dielectric constant in the locations K, M, the speed associated with the ground conductor G1 around the bend may be increased such that the electrical distance or electrical length of the ground conductor G1 may be matched to the virtual ground VG. Equalizing the speed in the vicinity of the bends may aid in equalizing the voltage through the bends at locations K, M with the virtual ground VG. That is, the decrease in the dielectric constant through the bends at locations K, M may aid in matching the electrical length of the longer conductor G1 to the virtual ground VG. Thus, a ratio of the reference length of the ground conductor G1 to that of the virtual ground VG may be larger than a ratio of the electrical length of the ground conductor G1 to that of the virtual ground VG.

The matching of the electrical lengths may be adjusted by adjusting the size of the pockets 850, 855. For example, the pockets 850, 855 may be sized such that a portion of the signal conductor S1 abuts the second dielectric material filling the pockets 850, 855. It should be recognized, of course, that the size of the pockets 850, 855 need not be the same as each other. Additionally, it should be recognized that alternative embodiments are envisioned where a pocket is formed at a right-angle bend of a ground conductor instead of including two pockets at respective 45° bends. Of course, other embodiments include other angled bends and pockets formed at one or more of such bends. Alternative embodiments may be incorporated into other connectors where a slot-line mode otherwise may be created, including in non-right-angle connectors.

Filling the pockets 850, 855 with a dielectric constant lower than the lead frame housing 820 may increase the impedance in the vicinity of the pockets 850, 855. Therefore, to provide uniformity of—or to match the impedance—in the vicinity of the pockets, the size, in cross-section, of the conductors G1, S1 in one or both pockets 850, 855 may be increased relative to the size of the remainder of the respective conductors G1, S2. As shown in FIG. 8, within the pockets 850, 855, the conductors G1, S1 include, respectively, additional conductive portions 861, 862. Therefore, the pockets 850, 855 may aid in matching the electrical distance of the conductor G1 with that of the virtual ground VG while the enlarged size of the conductors G1, S1 may aid in maintaining a matched impedance within the lead frame assembly 810.

It should be recognized that, in alternative embodiments, a pocket may be formed in the lead frame housing 820 around the conductor G2 in the vicinity of the locations K, M. A dielectric material having a dielectric constant higher than the remainder of the lead frame housing may be placed in the pocket. This may increase the electrical length of the ground conductor G2 to match the longer virtual ground. Thus, a dielectric material with a greater dielectric constant on the short conductor G2 may be used in addition to or as an alternative to using a dielectric material with a lesser dielectric constant on the longer conductor G1 to match it to the virtual ground VG.

It should be recognized that, in alternative embodiments, a lead frame assembly may include more than one pair of signal contacts. Therefore, for example, if the lead frame assembly 810 included a second differential signal pair having contacts shorter than the ground contact G2, the ground contact G2 would simultaneously be the shorter ground contact with respect to the virtual ground VG between signal conductors S1, S2 and the longer ground contact with respect to the virtual ground between the second differential signal pair. Therefore, pockets may be formed partially around ground conductors such as the ground conductor G2 such that the electrical length of the conductor may be matched on an upper side of the conductor with a longer virtual ground and on a lower side with a shorter virtual ground.

Figure 9A:
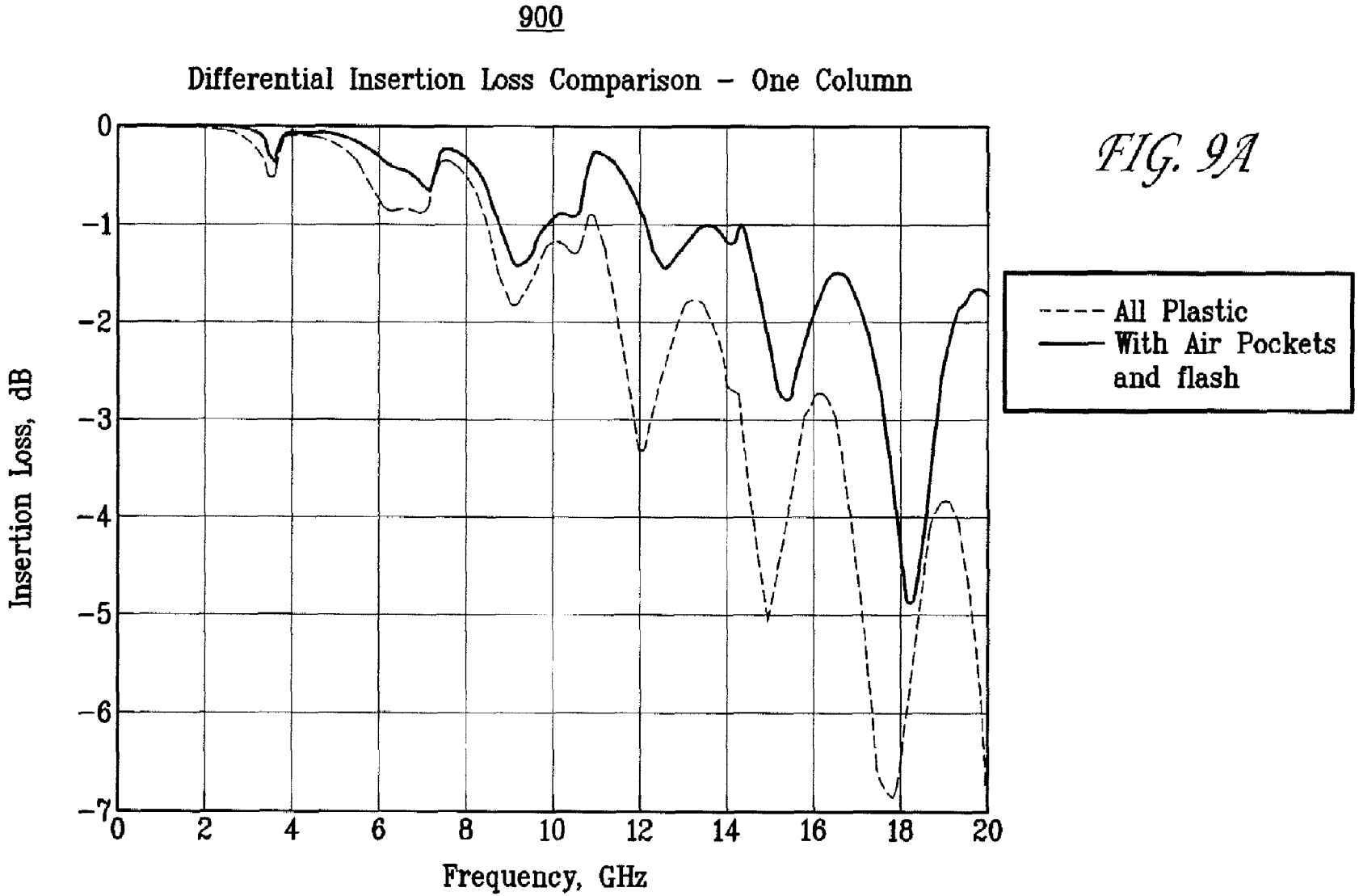
FIGS. 9A and 9B are graphical depictions for comparing insertion loss associated with the example lead frame assembly of FIG. 7 to the example lead frame assembly of FIG. 8.
Figure 9B:
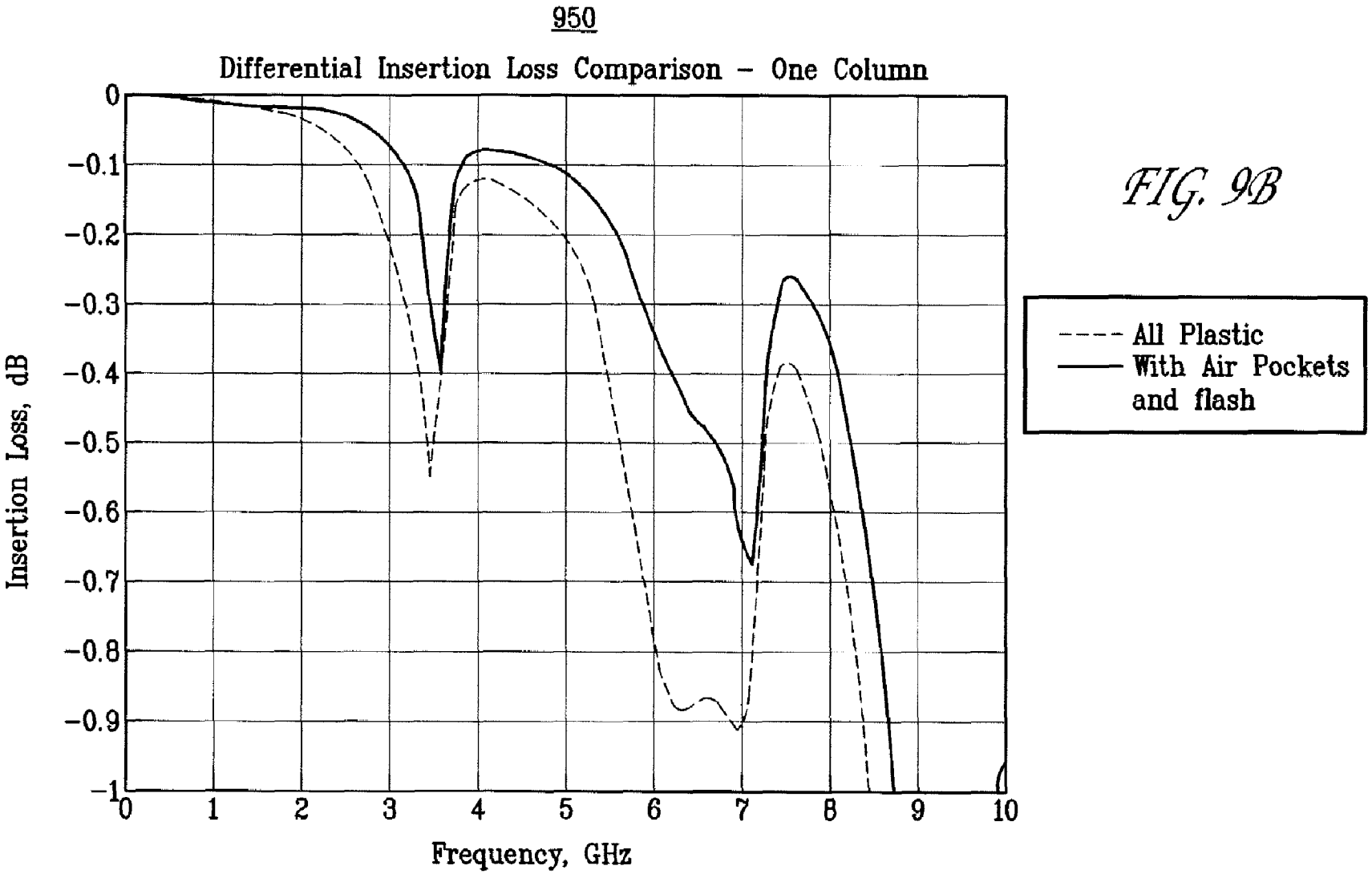

FIGS. 9A and 9B are graphical depictions 900, 950 for comparing insertion loss associated with, for example, the lead frame assembly 700 of FIG. 7 to the lead frame assembly 800 of FIG. 8. FIG. 9A shows insertion loss between 0 and 20 GHz, and FIG. 9B shows insertion loss between 0 and 10 GHz. The insertion loss associated with the lead frame assembly 700 of FIG. 7 is shown as a dotted line. The insertion loss associated with the lead frame assembly 800 is shown as a solid line. Generally, the graphical depictions 900, 950 show that the insertion loss associated with the lead frame assembly 800 is less than that associated with the lead frame assembly 700. For example, the insertion loss between approximately 3 and 4 GHz is over −0.5 dB for the assembly 700 and about −0.4 dB for the assembly 800. The insertion loss at approximately 7 GHz is about −0.9 dB for the assembly 700 and about −0.7 dB for the assembly 800. The insertion loss around 15 GHz is approximately −5 dB for the assembly 700 and −3 dB for the assembly 800. The insertion loss around 18 GHz is approximately −7 dB for the assembly 700 and −5 dB for the assembly 800.

Figure 10:
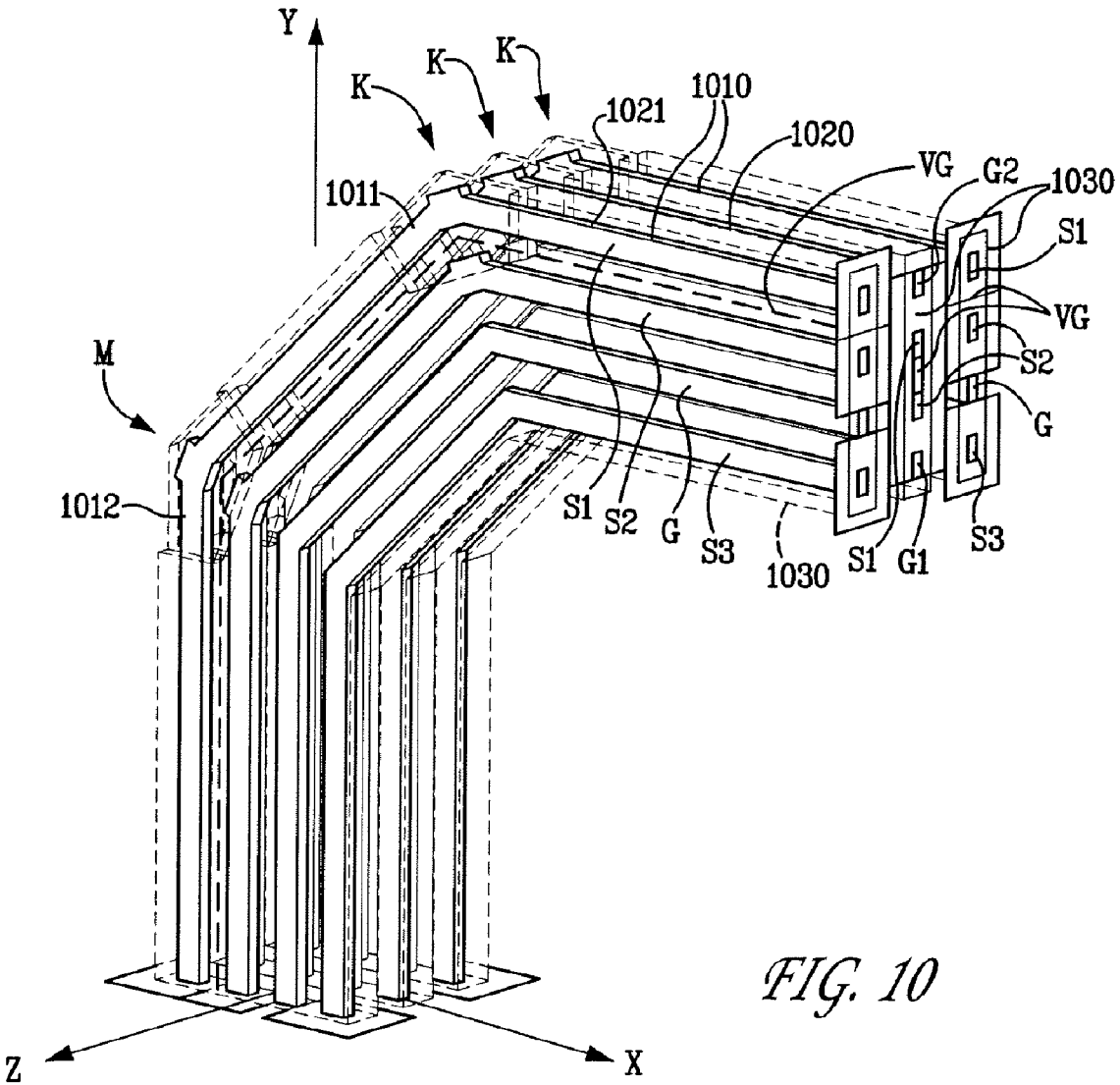
FIG. 10 is a perspective view of three example lead frame assemblies with pockets as they may be received in an electrical connector.

FIG. 10 is a perspective view of three lead frame assemblies, 1010, 1020 as they may be received in an electrical connector. Two lead frame assemblies 1010 may be on each side of the lead frame assembly 1020. The lead frame assemblies 1010 each may include signal conductors S1, S2, and S3 and a ground contact G. The signal conductors S1, S2 may form a differential signal pair. The signal conductor S3 may be a single-ended signal conductor or may form a differential signal pair with an adjacent conductor (not shown) of the lead frame assembly 1010.

Located between the lead frame assemblies 1010 may be the lead frame assembly 1020. The lead frame assembly 1020 may include a differential signal pair comprised of signal conductors S1, S2. The signal conductors S1, S2 of the lead frame assembly 1020 may be located between ground conductors G1, G2.

The signal conductors S1, S2 in each lead frame assembly 1010, 1020 may define a virtual ground reference VG midway between them. The conductor within each lead frame assembly 1010, 1020 may be encapsulated in a dielectric material of a lead frame housing 1030. That is, the lead frame housing 1030 may be, for example, plastic that encapsulates the conductors as well as the virtual ground VG of each lead frame assembly 1010, 1020.

With respect to the lead frame assembly 1020, the conductor G1 may be physically longer than the conductors S1, S2, G2, as well as the virtual ground VG. While the physical length of the conductor G1 may be longer than the virtual ground VG, the electrical length of the conductor G1 may be matched to the virtual ground VG. A first pocket 1021 may be formed in the lead frame housing 1020 in the vicinity of a location K where the conductor G1 may be bent at a 45° angle. A second pocket (not shown) may be formed in the vicinity of a location M where the conductor G1 may be bent at a 45° angle. The pockets may be filled with a second dielectric material that is different than the dielectric material of the lead frame housing 1030 to match the electrical lengths of the ground conductor G1 and the virtual ground VG of the lead frame assembly 1020.

As described in more detail with respect to FIGS. 5 and 8, for example, to match the impedance, or provide a uniform impedance, of the conductors G1, S1, the size, in cross-section, of the conductor G1, S1 in one or both pockets 1021 may be increased relative to the size of the remainder of the respective conductors G1, S2.

With respect to the lead frame assembly 1010, the virtual ground VG between the signal conductors S1, S2 may be longer than the ground conductor G. The electrical length of the virtual ground VG, however, may be matched to the ground conductor G. A first pocket 1011 may be formed in the lead frame housing 1010 in the vicinity of a location K where the signal conductors S1, S2 may be bent at a 45° angle. A second pocket 1012 may be formed in the vicinity of a location M where the signal conductors S1, S2 may again be bent at a 45° angle. The pockets 1011, 1012 may be filled with a second dielectric material that is different than the dielectric material of the lead frame housing 1030 to match the electrical lengths of the virtual ground VG and the ground conductor G of the lead frame assembly 1010.

To match the impedance of the signal contacts S1, S2, or provide a uniform impedance along the length of the signal contacts S1, S2, the size, in cross-section, of the conductors S1, S2 in one or both pockets 1011, 1012 may be increased relative to the size of the remainder of the respective conductors S1, S2.

Figure 11A:
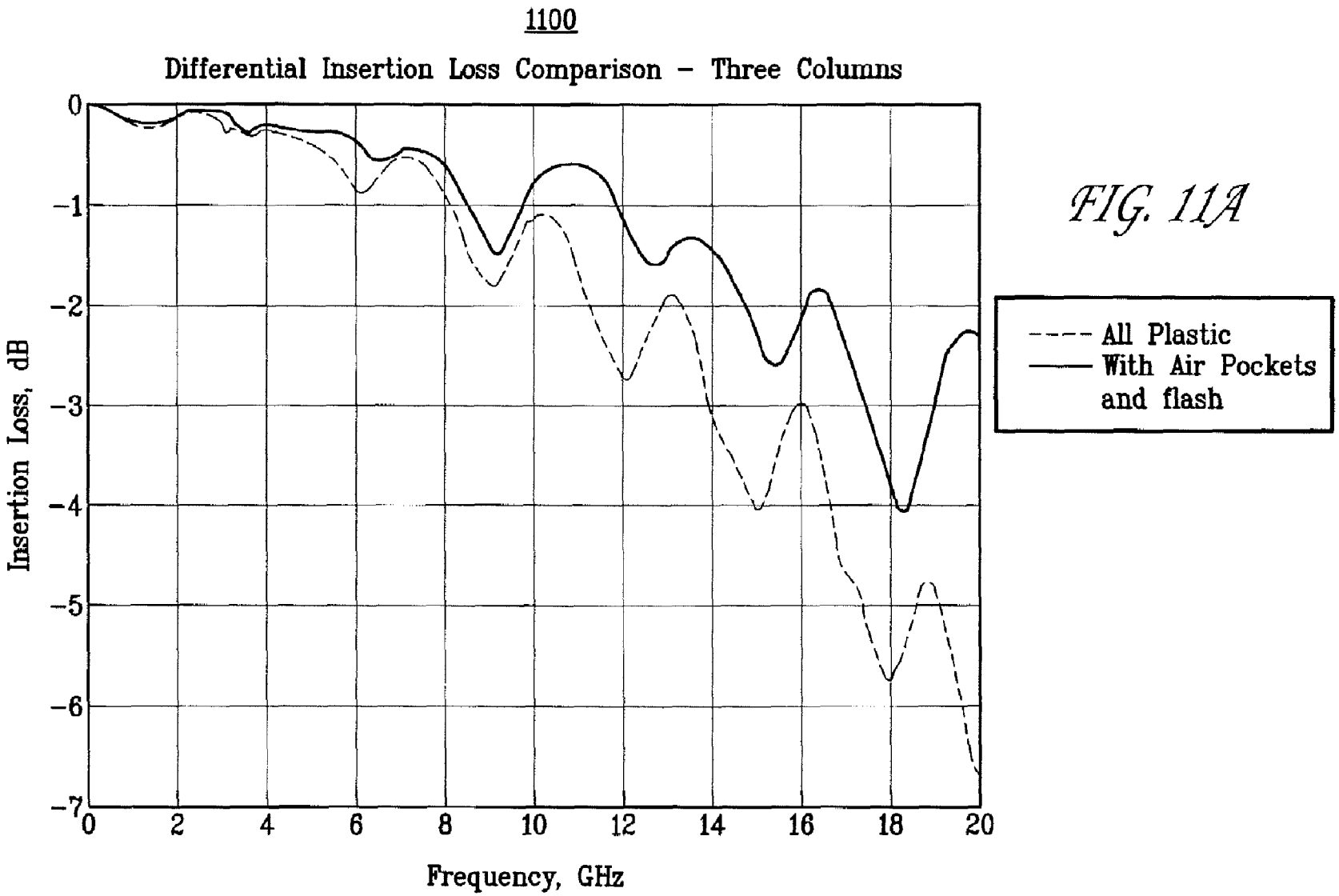
FIGS. 11A and 11B are graphical depictions for comparing insertion loss associated with the example lead frame assemblies with pockets of FIG. 10 with lead frame assemblies that do not include pockets.
Figure 11B:
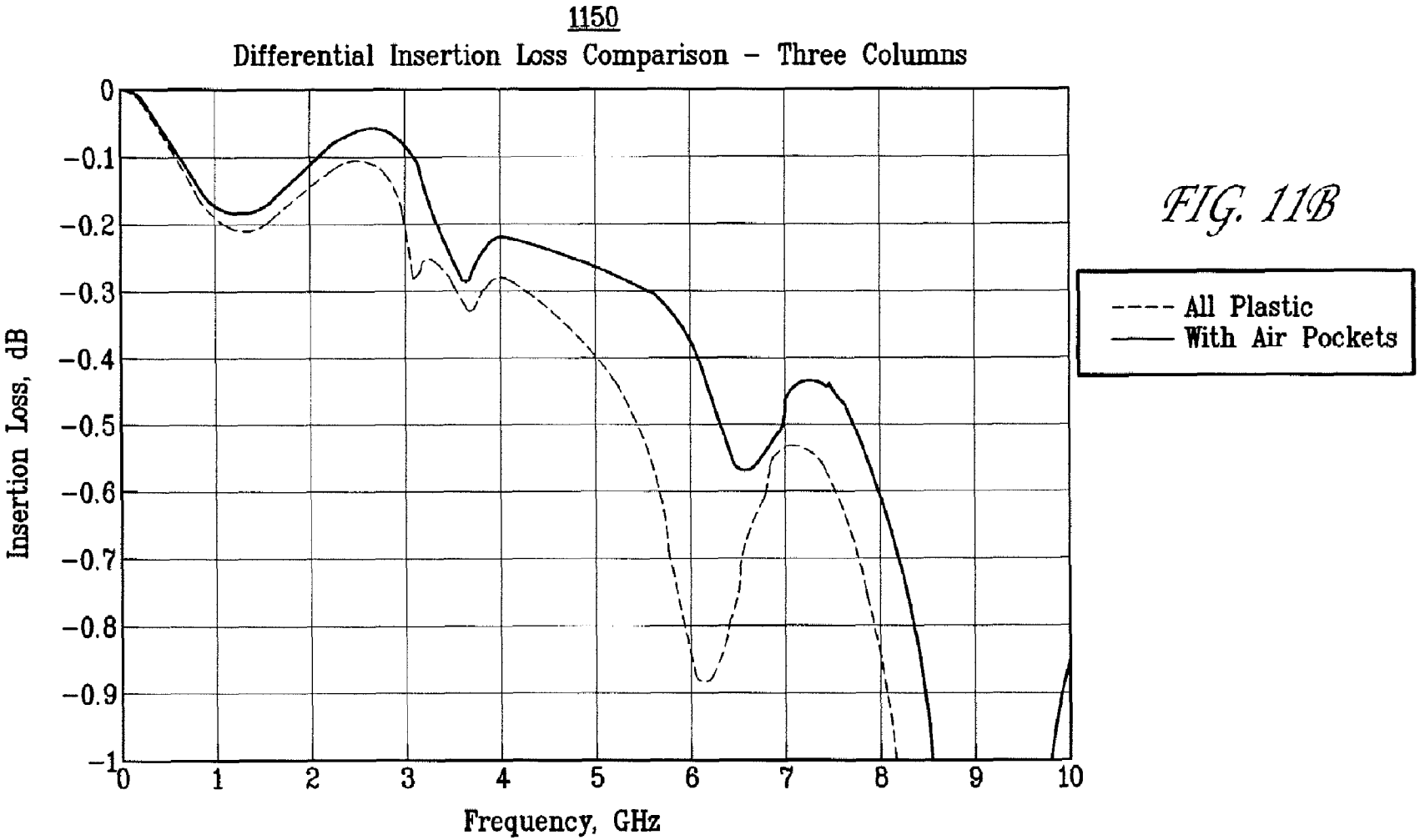

FIGS. 11A and 11B are graphical depictions 1100, 1150 comparing insertion loss associated with, for example, the lead frame assemblies with pockets of FIG. 10 with lead frame assemblies that do not include pockets. FIG. 11A shows insertion loss between 0 and 20 GHz, and FIG. 11B shows insertion loss between 0 and 10 GHz. The insertion loss associated with a lead frame assemblies devoid of pockets is shown as a dotted line. The insertion loss associated with the lead frame assemblies of FIG. 10 is shown as a solid line. Generally, the graphical depictions 1100, 1150 show that the insertion loss associated with the lead frame assemblies of FIG. 10 is less than that associated with lead frame assemblies devoid of pockets. For example, the insertion loss at approximately 4 GHz is over −0.3 dB for the assemblies devoid of pockets and less than −0.3 dB for the FIG. 10 assemblies. The insertion loss between approximately 6 and 7 GHz is about −0.9 dB for the assemblies devoid of pockets and less than −0.6 dB for the FIG. 10 assemblies. The insertion loss around 15 GHz is approximately −4 dB for the assemblies devoid of pockets and about −2.5 dB for the FIG. 10 assemblies. The insertion loss around 18 GHz is over −5 dB for the assemblies devoid of pockets and about −4 dB for the FIG. 10 assemblies.

Figure 12:
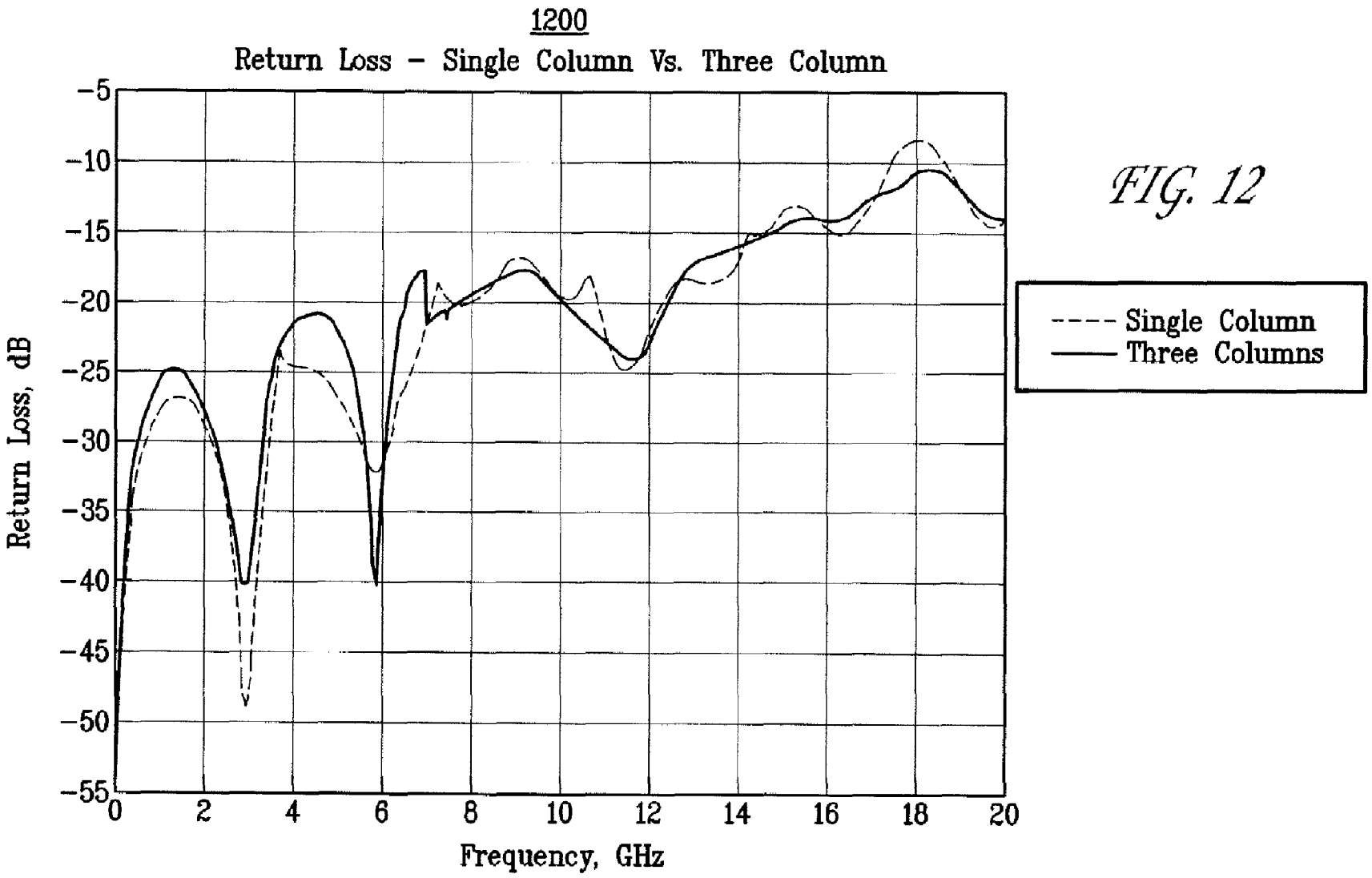
FIG. 12 is a graphical depiction for comparing return loss of a single lead frame assembly with pockets and three lead frame assemblies with pockets.

FIG. 12 is a graphical depiction for comparing return loss of a single lead frame assembly such as shown in FIG. 8 with three lead frame assemblies such as shown in FIG. 10.

Figure 13:
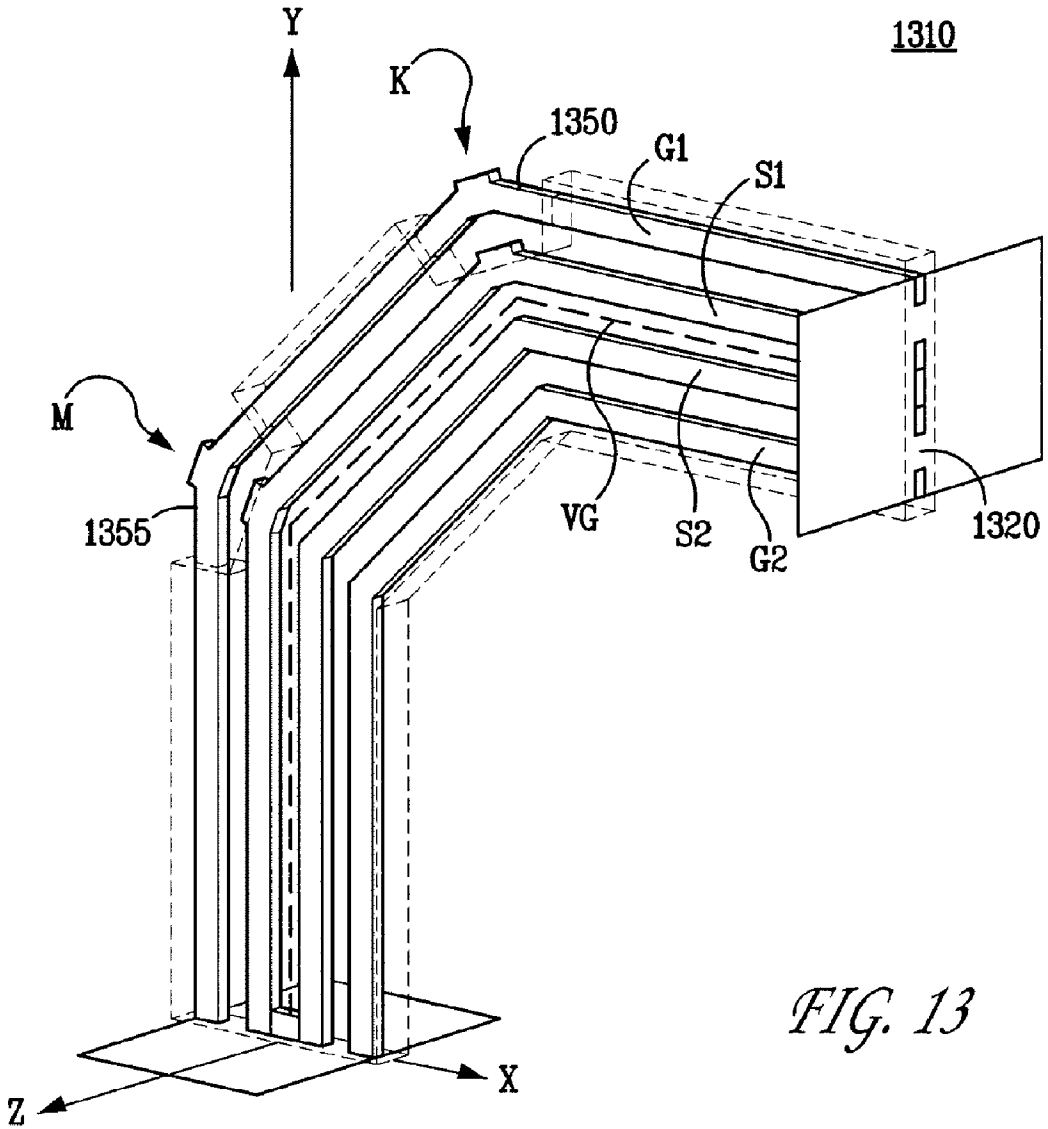
FIG. 13 is a perspective view of an example lead frame assembly with flashing removed in pockets.

FIG. 13 is a partial perspective view of a lead frame assembly 1310. The lead frame assembly 1310 may include ground conductors G1, G2 and signal conductors S1, S2. The signal conductors S1, S2 may form a differential signal pair and may define a virtual ground reference VG midway between them, denoted by a dotted line. The contacts S1, S2, G1, G2, as well as the virtual ground VG, may lie in a plane defined by arrows X and Y.

The signal conductor S1, S2 and ground conductors G1, G2 may be encapsulated in a dielectric material of a lead frame housing 1320. The conductor G1 may be physically longer than the conductors S1, S2, G2, as well as the virtual ground VG. While the physical length of the conductor G1 may be longer than the virtual ground VG, the electrical length of the conductor G1 may be matched to the virtual ground VG. A first pocket 1350 may be formed in the lead frame housing 1320 in the vicinity of a location K where the conductor G1 is bent at a 45° angle. A second pocket 1355 may be formed in the vicinity of a location M where the conductor G1 is again bent at a 45° angle. The pockets 1350, 1355 may be formed in the lead frame housing 1320 such that none of the lead frame housing 1320 abuts the ground conductor G1 in the vicinity of locations K, M. For example, pockets may be formed by removing dielectric material from sides of the conductors, removing flash located in the gap between the ground conductor G1 and the signal conductor S1, or both. Thus, the dielectric material, such as, for example, air, located adjacent to the lead frame assembly 1310 in an electrical connector may also fill the pockets 1350, 1355. The pockets 1350, 1355 may be filled with a second dielectric material that is different than the dielectric material of the lead frame housing 1320. A decrease in the dielectric constant through the bends at locations K, M may aid in matching the electrical length or electrical distance of the longer conductor G1 to the virtual ground VG.

The matching of the electrical lengths may be adjusted by adjusting the size of the pockets 1350, 1355. For example, the pockets 1350, 1355 may be sized such that a portion of the signal conductor S1 abuts the second dielectric material filling the pockets 1350, 1355. Additionally, the size of the pockets 1350, 1355 may be less than the size of the pockets 850, 855 of FIG. 8, for example, because removal of the flash may allow more of the ground conductor G1 of the lead frame assembly 1310 to abut the second dielectric.

In the example embodiment of FIG. 13, filling the pockets 1350, 1355 with a dielectric material having a dielectric constant lower than the lead frame housing 1320 may increase the impedance of the conductors G1, S1. Therefore, as explained herein, to match the impedance of the conductors G1, S1, S2 the size, in cross-section, of the conductors G1, S1 in one or both pockets 1350, 1355 may be increased relative to the size of the remainder of the respective conductors G1, S2.

It should be recognized that, in alternative embodiments, a pocket may be formed in the lead frame housing 1320 around the conductor G2 in the vicinity of the locations K and M. A dielectric material having a dielectric constant higher than the remainder of the lead frame housing may be placed in the pocket. This may increase the electrical length of the ground conductor G2 to match the longer virtual ground. Thus, a dielectric material with a greater dielectric constant on the short conductor G2 may be used in addition to or as an alternative to using a dielectric material with a lower dielectric constant on the longer conductor G1 to match it to the virtual ground VG.

Additionally, it should be recognized that, in alternative embodiments, a lead frame assembly may include more than one pair of signal contacts. Therefore, for example, if the lead frame assembly 1310 included a second differential signal pair including conductors having a short physical length than the ground conductor G2, the ground conductor G2 would simultaneously be the shorter ground conductor with respect to the virtual ground VG between signal conductors S1, S2 and a longer ground conductor with respect to the virtual ground between the second differential signal pair. Therefore, pockets may be formed partially around ground conductors such as the ground conductor G2 such that the electrical length of the conductor may be matched on an upper side of the conductor with a longer virtual ground and on a lower side with a shorter virtual ground.

Figure 14A:
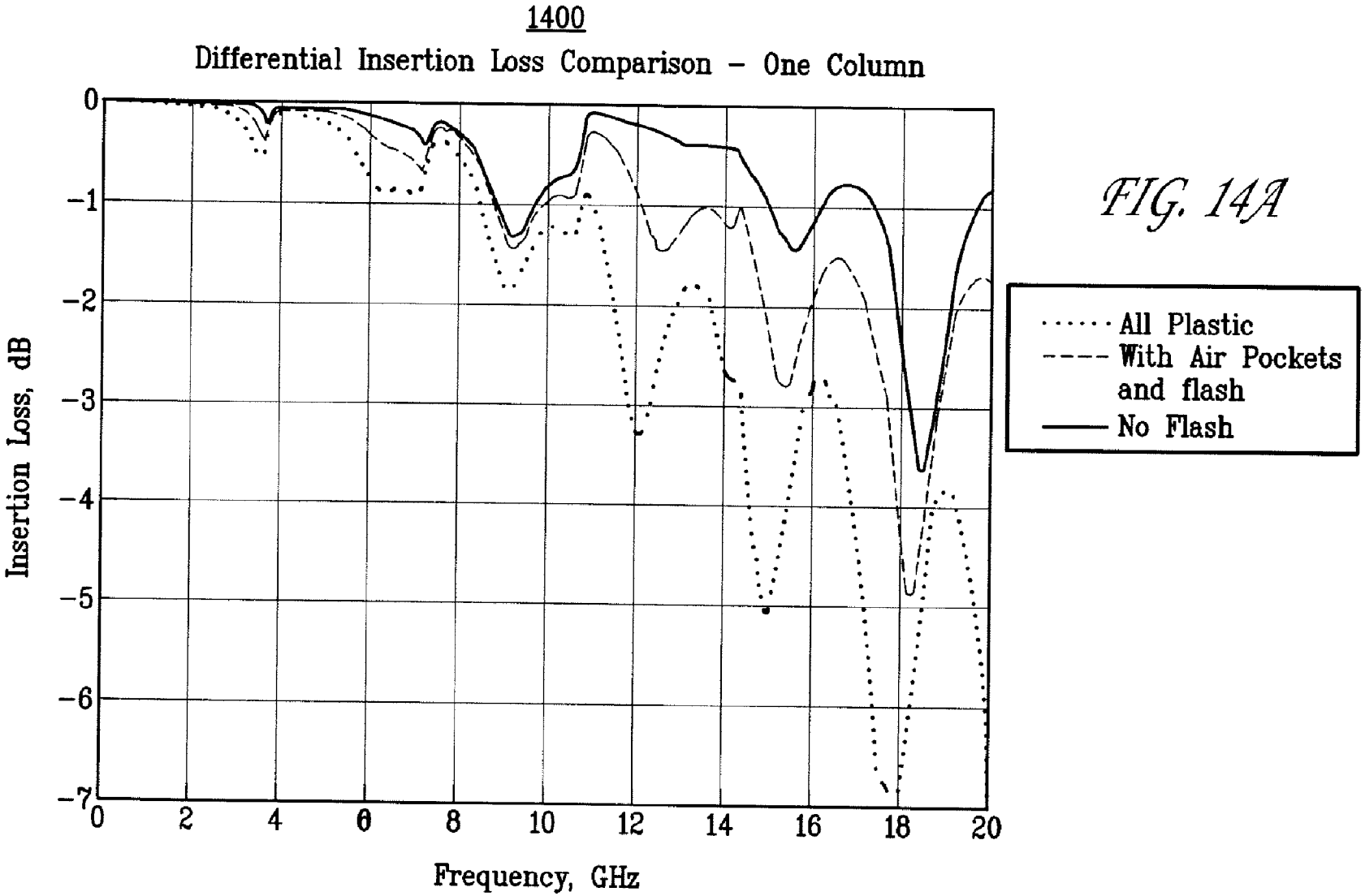
FIGS. 14A and 14B are graphical depictions for comparing insertion loss associated with the example lead frame assemblies of FIG. 7, FIG. 8, and FIG. 13.
Figure 14B:
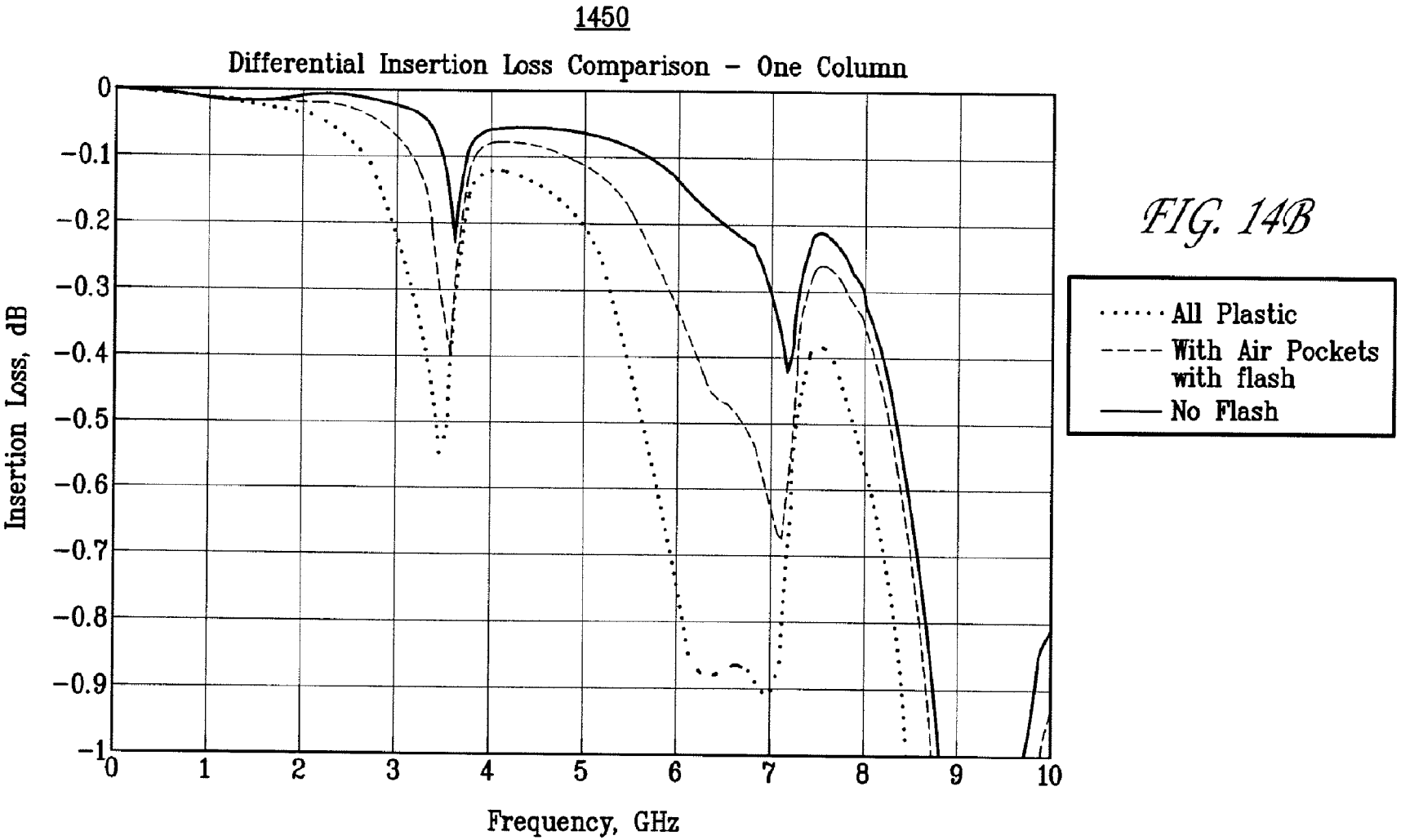

FIGS. 14A and 14B are graphical depictions 1400, 1450 for comparing insertion loss associated with, for example, the lead frame assembly 710 of FIG. 7, the lead frame assembly 810 of FIG. 8 that includes pockets and a flash within the pockets, and the lead frame assembly 1310 of FIG. 13 that includes pockets devoid of a flash. FIG. 14A shows insertion loss between 0 and 20 GHz, and FIG. 14B shows insertion loss between 0 and 10 GHz. The insertion loss associated with the lead frame assembly 710 of FIG. 7 is shown as a dotted line. The insertion loss associated with the lead frame assembly 810 is shown as a dashed line. The insertion loss associated with the lead frame assembly 1310 is shown as a solid line. Generally, the graphical depictions 1400, 1450 show that the insertion loss associated with the lead frame assembly 810 is less than that associated with the lead frame assembly 710, and that the insertion loss associated with the lead frame assembly 1310 is lower than that associated with the lead frame assembly 810. For example, the insertion loss between approximately 3 and 4 GHz is over −0.5 dB for the assembly 710, about −0.4 dB for the assembly 810, and about −0.2 dB for the assembly 1310. The insertion loss between at approximately 7 GHz is about −0.9 dB for the assembly 710, about −0.7 dB for the assembly 810, and −0.4 dB for the assembly 1310. The insertion loss around 15 GHz is approximately −5 dB for the assembly 710, −3 dB for the assembly 810, and −1.5 dB for the assembly 1310. The insertion loss around 18 GHz is approximately −7 dB for the assembly 710, −5 dB for the assembly 810, and under −4 dB for the assembly 1310.

Figures 15A, 15B:
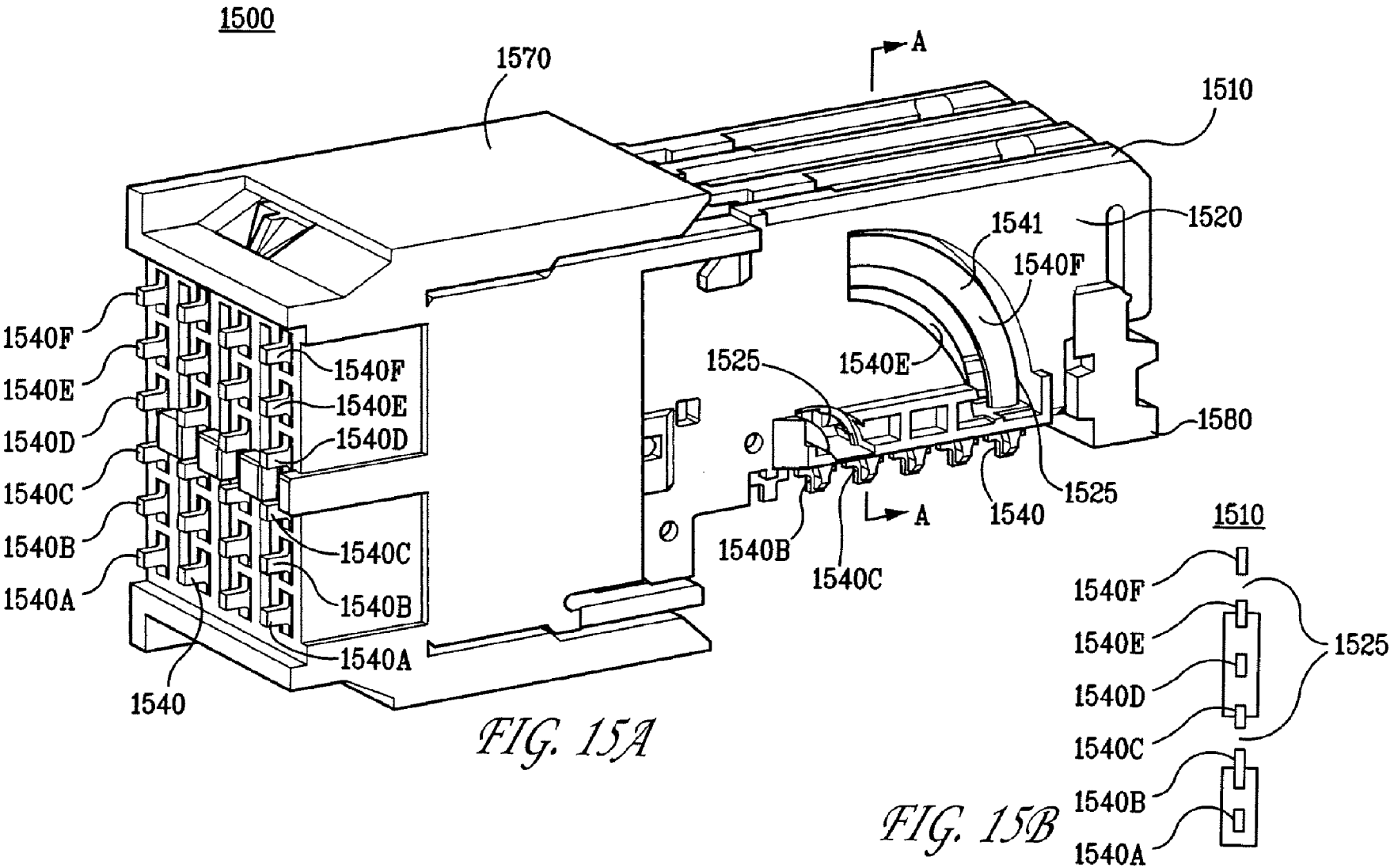
FIG. 15A is a perspective view of an example electrical connector with arced contacts contained in example lead frame assemblies.
FIG. 15B is a cross-sectional view of an example lead frame assembly taken along line AA shown in FIG. 15A.

FIG. 15A is a perspective view of an example electrical connector 1500. FIG. 15B is a cross-section view of a lead frame assembly 1510 taken along line AA shown in FIG. 15A. FIG. 15A is a perspective view of an example right angle connector 1500, though other embodiments may be implemented in other types of connectors.

The connector 1500 may include lead frame assemblies 1510. The lead frame assemblies 1510 may include a lead frame housing 1520 as well as ground and signal contacts 1540. The contacts 1540 may bend in an arc within the lead frame housing 1520 such that the connector 1500 may connect a first substrate to a second substrate that is perpendicular or at a right angle to the first substrate. The lead frame assemblies 1510 may be secured within a housing 1570 and may be retained in the connector 1500 by a retaining member 1580. The lead frame housing 1520 may be made of a dielectric material such as plastic.

The contacts 1540 may form an arc 1541 through the lead frame housing 1520. The contacts 1540A-F within each lead frame assembly 1510 may be either ground or signal contacts. Additionally, the signal conductors may carry single-ended signal transmissions or may be paired for differential signal transmission.

The conductor 1540F may be the outermost conductor and may be longer than all other conductors within the lead frame assembly 1510. The conductor 1540E may be longer than all other conductors except the conductor 1540F. This pattern may continue from the outer to the inner conductors. While the physical length of outer conductors may be longer than inner conductors, the electrical length of the outer ground conductors or outer virtual ground references may be matched to appropriate inner ground conductors or to appropriate virtual grounds.

The lead frame housing 1520 may include pockets 1525 filled with a second dielectric material such as air. The second dielectric material may partially abut contacts such as 1540B and may partially abut contacts 1540C, 1540E. Abutments can change column-to-column if differential signal pairs are staggered column-to-column. By reducing the dielectric constant within the pockets 1525, the speed associated with the ground conductors or virtual grounds around the bend of the outer conductors may be increased such that the electrical distances or electrical lengths may be matched.

In the example embodiment of FIGS. 15A, 15B, filling the pockets 1525 with a dielectric material having a dielectric constant lower than the lead frame housing 1520 may increase the impedance of the conductors 1540B, 1540C, 1540E, 1540F in the pockets. Therefore, to match the impedance of the transmission path or to provide for uniform impedance along respective conductors, the size, in cross-section, of the conductors in both the pockets 1525 may be increased relative to the size of the remainder of the respective conductors.

Figure 16A:
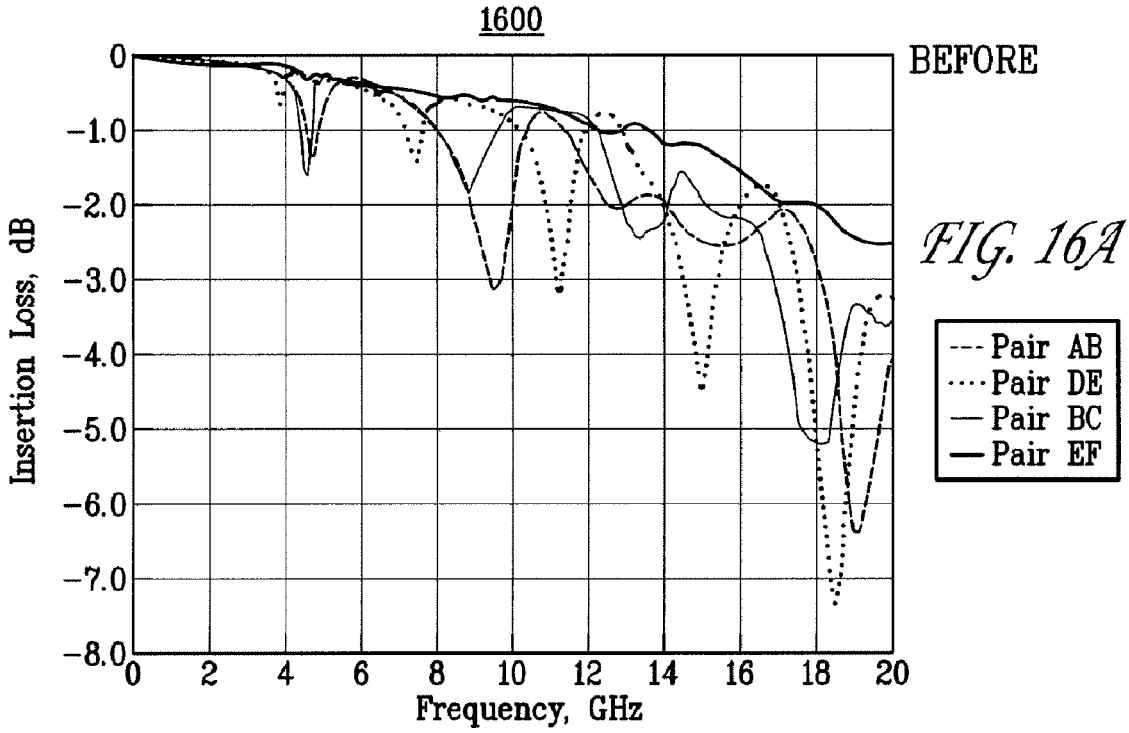
FIG. 16A is a graphical depiction of insertion loss associated with pairs of signal contacts in a connector devoid of pockets.
Figure 16B:
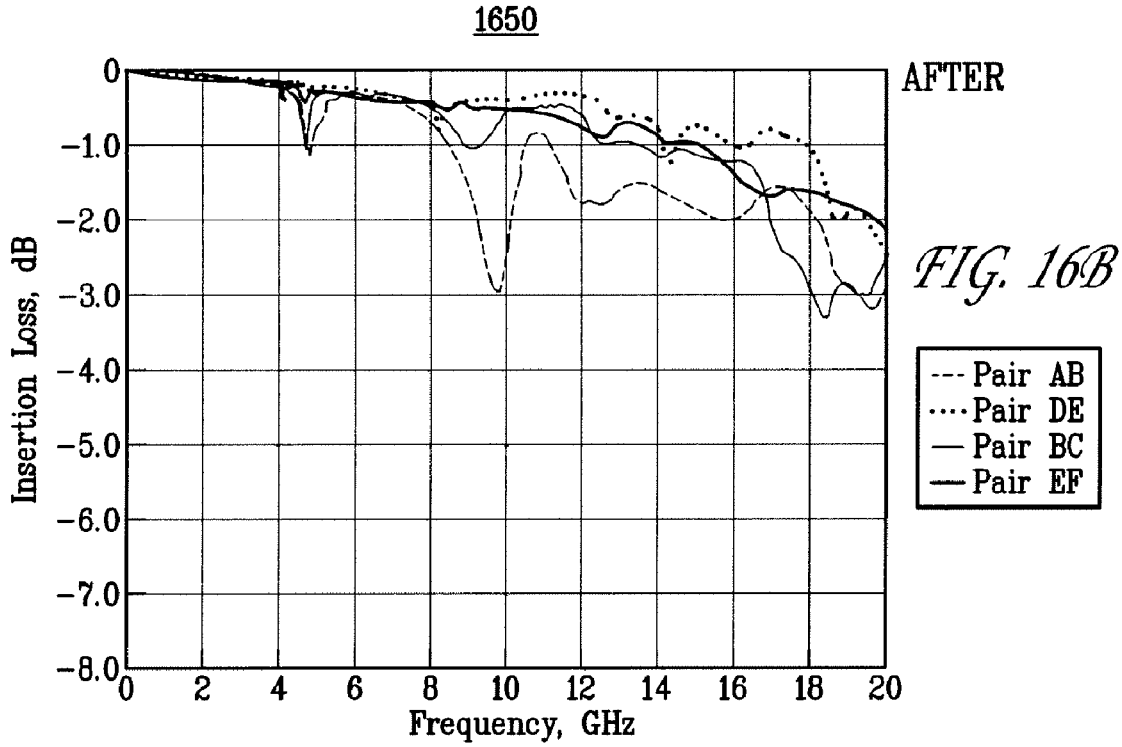
FIG. 16B is a graphical depiction of insertion loss associated with pairs of signal contacts in a connector having lead frame assemblies that include pockets.
Figure 16C:
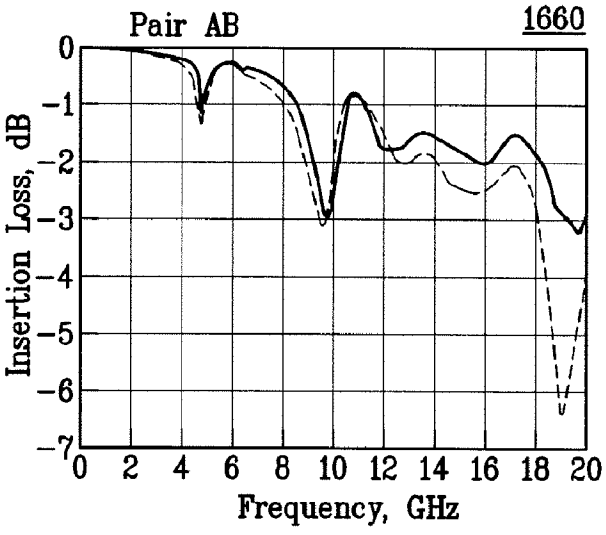
FIGS. 16C-16F are graphical depictions showing a respective comparison of the insertion loss associated with specified contact pairs of a connector devoid of pockets with a connector that includes pockets.
Figure 16D:
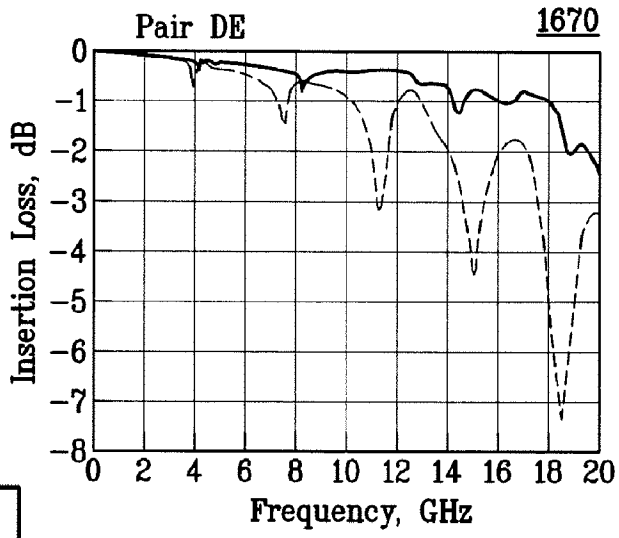
Figure 16E:
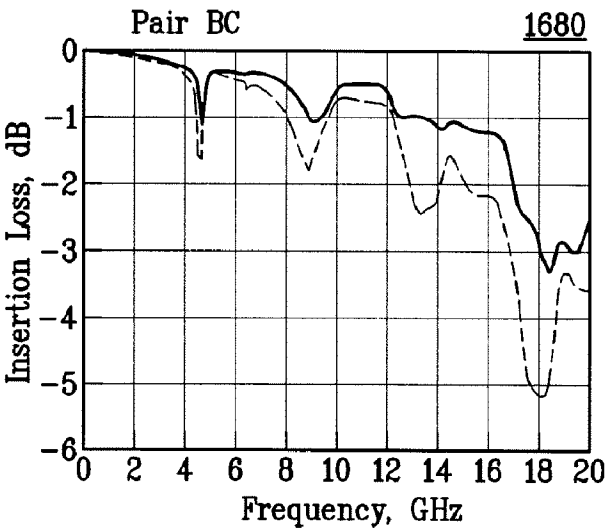
Figure 16F:
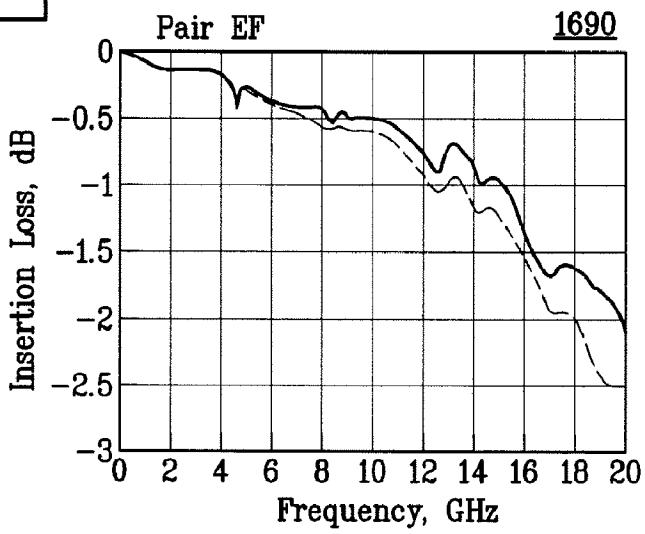

FIG. 16A is a graphical depiction of insertion loss associated with pairs of signal contacts AB, DE, BC, EF in a connector similar to the connector 1500 except that the lead frame assemblies are devoid of pockets. FIG. 16B is a graphical depiction of insertion loss associated with pairs of signal contacts AB, DE, BC, EF in the connector 1500, where the lead frame assemblies include pockets. FIGS. 16C-16F are graphical depictions showing a respective comparison of the insertion loss associated with contact pairs AB, DE, BC, EF of a connector devoid of pockets with the connector 1500 that includes pockets.

With regard to a connector devoid of pockets, the insertion loss associated with the pair DE (dotted line in FIG. 16A and dashed line in FIG. 16D) is shown to reach over −7 dB at about 18.5 GHz. The insertion loss associated with the pair AB (dashed line in FIGS. 16A and 16C) is shown to reach about −6.5 dB at about 19 GHz. The insertion loss associated with the pair BC (un-bolded line in FIG. 16A and dashed line in FIG. 16E) is shown to reach over −5 dB at about 18 GHz. The insertion loss associated with the pair EF (bolded-solid line in FIG. 16A and dashed line in FIG. 16F) reaches about −2.5 dB at about 19 GHz.

With regard to a connector such as the connector 1500 that includes pockets, the insertion loss associated with the pair BC (solid line in FIGS. 16B and 16E) and the pair AB (dashed line in FIG. 16B and solid line in FIG. 16C) reaches about −3 dB at about 19 GHz. The insertion loss associated with the pair DE (dotted line in FIG. 16B and solid line in FIG. 16D) reaches about −2.5 dB at about 20 GHz. The insertion loss associated with the pair EF (bolded-solid line in FIGS. 16B and 16F) is −2 dB at about 20 GHz.

Figure 17:
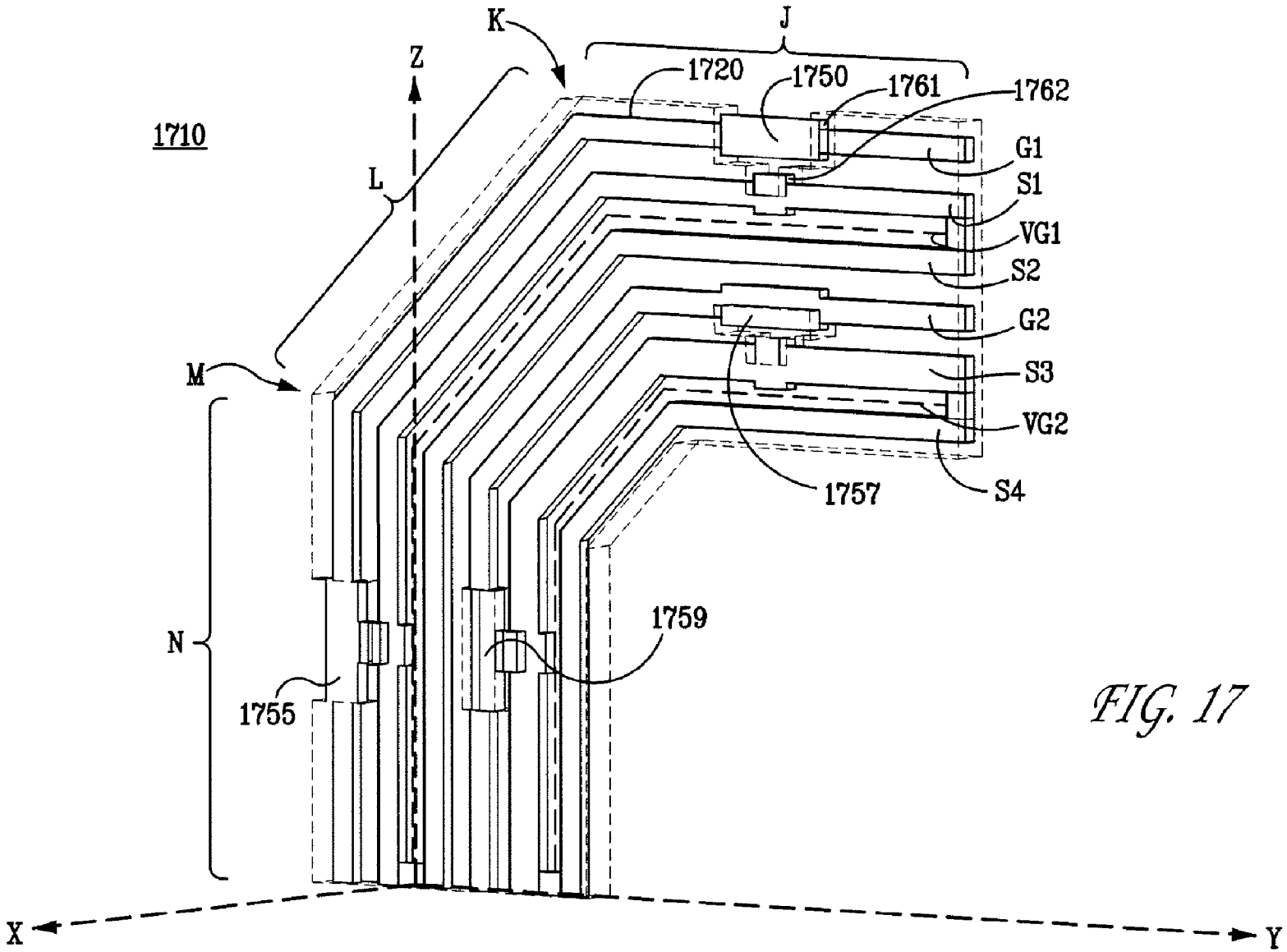
FIG. 17 is a partial perspective view of an example lead frame assembly with pockets formed along straight portions of conductors.

FIG. 17 is a partial perspective view of a lead frame assembly 1710. The lead frame assembly 1710 may include ground conductors G1, G2 and signal conductors S1, S2, S3, S4. The signal conductors S1, S2 may form a first differential signal pair and may define a virtual ground reference VG1 midway between them. The signal conductors S3, S4 may form a second differential signal pair and may define a virtual ground reference VG2 midway between them. The virtual grounds VG1, VG2 are denoted in FIG. 17 by dotted lines. The contacts S1, S2, S3, S4, G1, G2, as well as the virtual grounds VG1, VG2, may lie in a plane defined by arrows X and Y. The perspective view in FIG. 17 shows the contacts extending in a lead frame housing 1720. The distal ends of the contacts and the edges of the lead frame housing 1720 may not be shown for purposes of clarity.

The conductors S1-S4, G1, G2 may be encapsulated in a dielectric material of the lead frame housing 1720. That is, the lead frame housing 1720 may be, for example, plastic that encapsulates the contacts S1-S4, G1, G2 as well as the virtual grounds VG1, VG2. In FIG. 17, the contacts S1-S4, G1, G2 are shown as if encapsulated in a clear lead frame housing 1720; however, the lead frame housing 1720 may be opaque.

The lead frame assembly 1710 may include segments J, L, and N. The segment J, for example, may extend in a direction indicated by the arrow Y. The segment N may extend in a direction indicated by the arrow Z. The Y direction may be perpendicular to the X direction. Between the J and N segments may be the segment L. The segment L may be at a 45° angle with the segment J. The segment L may be at a 45° angle with the segment N. The conductors S1-S4, G1, G2 as well as the virtual grounds VG1, VG2, may likewise bend in the vicinity of locations K, M to form right angle conductors.

The conductor G1 may be physically longer than the conductors S1-S2, as well as the virtual ground VG1. While the physical length of the conductor G1 may be longer than the virtual ground VG, the electrical length of the conductor G1 may be matched to the virtual ground VG1. A first pocket 1750 may be formed in the lead frame housing 1720 within the segment J. A second pocket 1755 may be formed within the segment N. The pockets 1750, 1755 may be formed in the lead frame housing 1720 such that some of the lead frame housing 1720 abuts the ground conductor G1 within the segments J and N. The pockets 1750, 1755 may be filled with a second dielectric material that is different than the dielectric material of the lead frame housing 1720. For example, the pockets 1750, 1755 may be filled with air or another dielectric material that includes a dielectric constant that is less than the dielectric constant of the material of the lead frame housing 1720.

By reducing the dielectric constant in the segments J and N, the speed associated with the ground conductor G1 along the segments may be increased such that the electrical distance or electrical length of the ground conductor G1 may be matched to the virtual ground VG1. Equalizing the speed within the segments J and N, as with increasing the speed around the bends, as described herein, may aid in equalizing the voltage over the length of the ground G1. That is, the decrease in the dielectric constant along the "straight" segments J and N may aid in matching the electrical length of the longer conductor G1 to the virtual ground VG1. Thus, a ratio of the reference length of the ground conductor G1 to that of the virtual ground VG1 may be larger than a ratio of the electrical length of the ground conductor G1 to that of the virtual ground VG1.

The matching of the electrical lengths may be adjusted by adjusting the size and/or shape of the pockets 1750, 1755. For example, the pockets 1750, 1755 may be sized such that a portion of the signal conductor S1 abuts the second dielectric material filling the pockets 1750, 1755. It should be recognized, of course, that the size of the pockets 1750, 1755 need not be the same as each other. Of course, other embodiments include other pockets formed at one or more of the bends at locations K, M or along segment L. Moreover, more than one pocket may be placed along the segments J, L, N. Alternative embodiments may be incorporated into other connectors where a slot-line mode otherwise may be created, including in non-right-angle connectors.

Filling the pockets 1750, 1755 with a dielectric constant lower than the lead frame housing 1720 may increase the impedance in the vicinity of the pockets 1750, 1755. Therefore, to provide uniformity of—or to match the impedance—in the vicinity of the pockets, the size, in cross-section, of the conductors G1, S1 in one or both pockets 1750, 1755 may be increased relative to the size of the remainder of the respective conductors G1, S2. As shown in FIG. 17, within the pockets 1750, 1755, the conductors G1, S1 include, respectively, additional conductive portions 1761, 1762. Therefore, the pockets 1750, 1755 may aid in matching the electrical distance of the conductor G1 with that of the virtual ground VG1 while the enlarged size of the conductors G1, S1 may aid in maintain a matched impedance within the lead frame assembly 1710.

In a similar manner, the conductor G2 may be physically longer than the conductors S3, S4, as well as the virtual ground VG2. While the physical length of the conductor G2 may be longer than the virtual ground VG2, the electrical length of the conductor G2 may be matched to the virtual ground VG2. A third pocket 1757 may be formed in the lead frame housing 1720 within the segment J. A second pocket 1759 may be formed within the segment N. The pockets 1757, 1759 may be formed in the lead frame housing 1720 such that some of the lead frame housing 1720 abuts the ground conductor G2 within the segments J and N. The pockets 1757, 1759 may be filled with a second dielectric material that is different than the dielectric material of the lead frame housing 1720. For example, the pockets 1757, 1759 may be filled with air or another dielectric material that includes a dielectric constant that is less than the dielectric constant of the material of the lead frame housing 1720.

By reducing the dielectric constant in the segments J and N, the speed associated with the ground conductor G2 along the segments may be increased such that the electrical distance or electrical length of the ground conductor G2 may be matched to the virtual ground VG2. Equalizing the speed within the segments J and N, as with increasing the speed around the bends, as described herein, may aid in equalizing the voltage over the length of the ground G2. That is, the decrease in the dielectric constant along the straight segments J and N may aid in matching the electrical length of the longer conductor G2 to the virtual ground VG2. Thus, a ratio of the physical or reference length of the ground conductor G2 to that of the virtual ground VG2 may be larger than a ratio of the electrical length of the ground conductor G2 to that of the virtual ground VG2.

The matching of the electrical lengths may be adjusted by adjusting the size and/or shape of the pockets 1757, 1759. For example, the pockets 1757, 1759 may be sized such that a portion of the signal conductor S3 abuts the second dielectric material filling the pockets 1757, 1759. It should be recognized, of course, that the size of the pockets 1757, 1759 need not be the same as each other. Of course, other embodiments include other pockets formed at one or more of the bends at locations K, M or along segment L. Moreover, more than one pocket may be placed along the segments J, L, N. Alternative embodiments may be incorporated into other connectors where a slot-line mode otherwise may be created, including in non-right-angle connectors.

Figure 18:
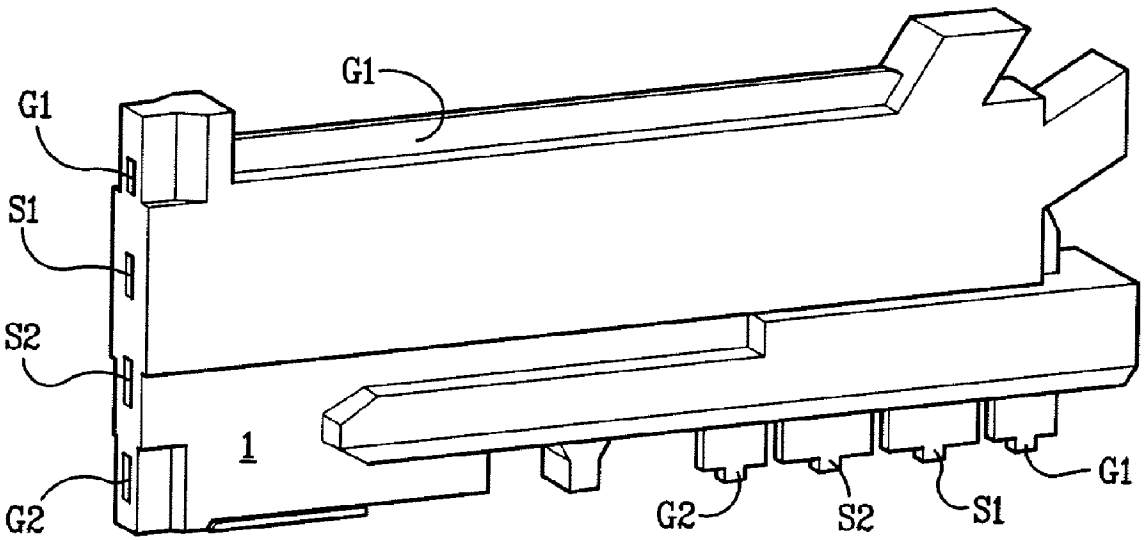
FIG. 18 shows an illustration of an alternative lead frame housing supporting ground leads and a differential pair of signal leads.

FIG. 18 shows an illustration of an alternative lead frame housing 1 supporting a differential pair of signal leads S1, S2 and ground leads G1, G2. The lead frame housing may be manufactured from plastic, and the signal leads S1, S2 and ground leads G1, G2 may be embedded in or molded as part of the plastic lead frame housing 1. Such a lead frame housing 1 may be used in an electrical connector (not shown).

Figure 19:
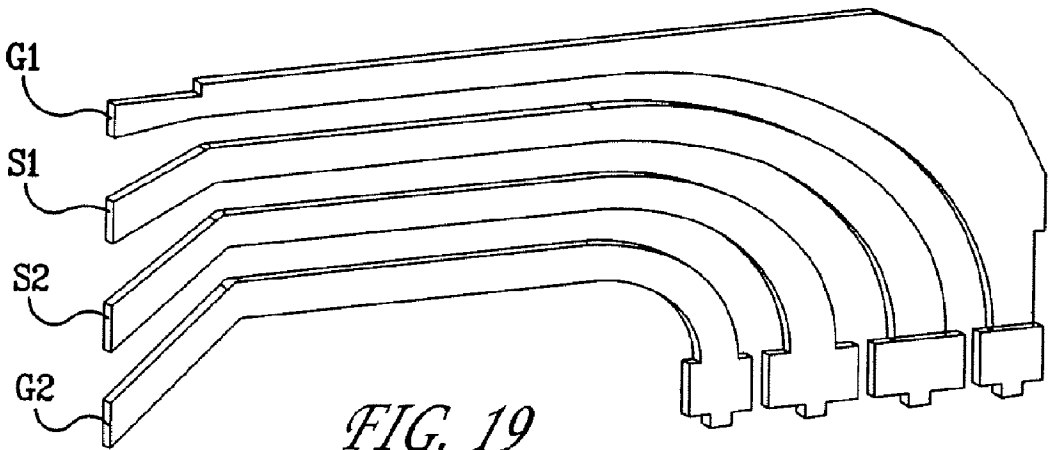
FIG. 19 depicts co-planar signal leads and ground leads.

The signal leads S1, S2 and ground leads G1, G2 may be co-planar and follow a path as depicted in FIG. 19. Ground leads G1, G2 may be located on opposite sides of the differential pair of signal leads S1, S2.

In particular, the lead frame housing 1 of FIG. 18 may be used in a right-angle connector. In such a connector, the signal leads S1, S2 and ground leads G1, G2 may bend within the lead frame housing. The physical lengths of the ground leads G1, G2 may be different. In particular, the physical length of the first ground lead G1 is larger than the physical length of the second ground lead G2. Furthermore, coupling of signals from the signal leads S1, S2 to in particular the first ground lead G1 may be effected via the dielectric material of the lead frame housing 1.

Figure 20:
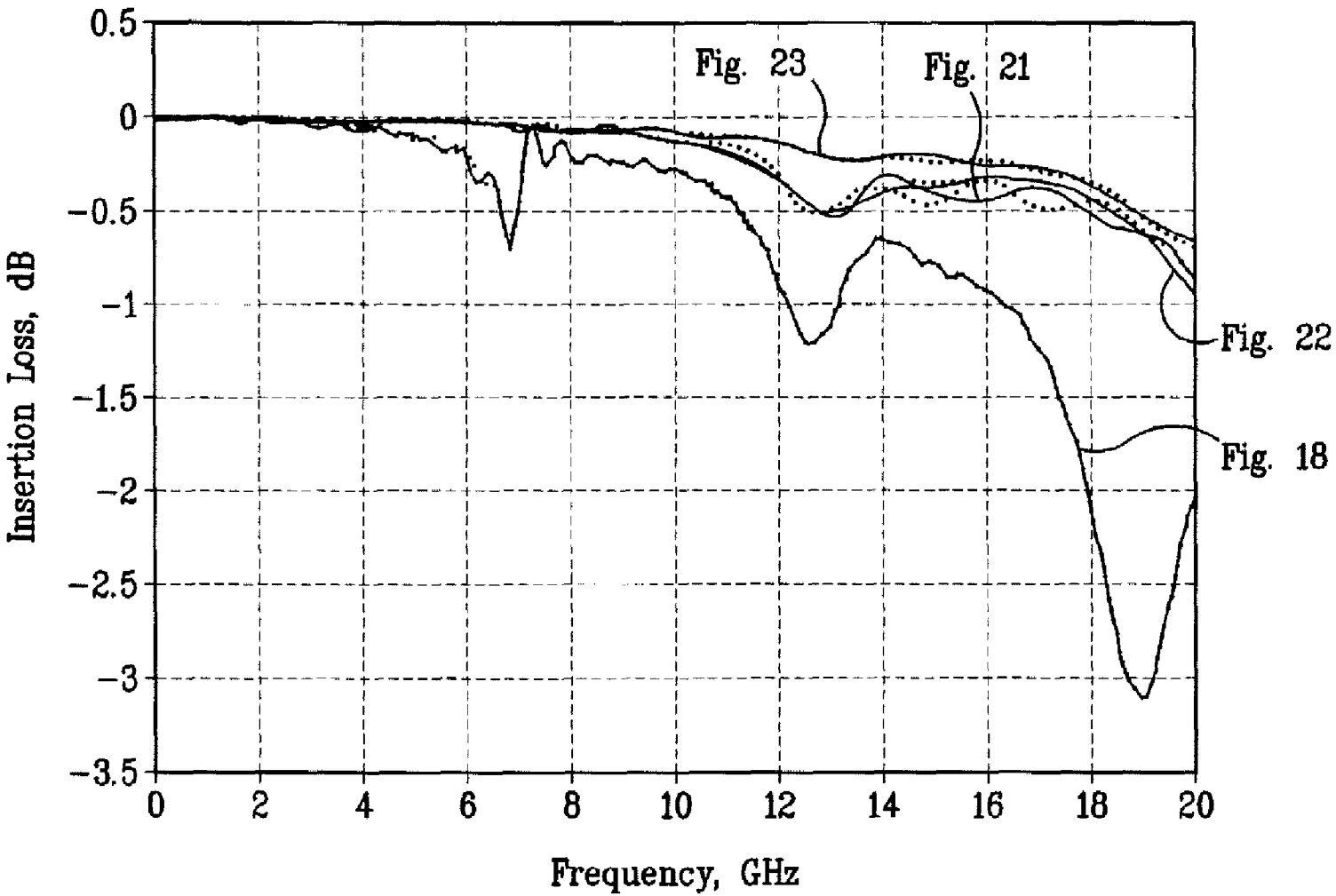
FIG. 20 is a plot of insertion loss as a function of frequency.

These phenomena may contribute to the insertion loss characteristic of the differential signal pair S1, S2 housed in the lead frame housing 1 of FIG. 18. This characteristic is depicted in FIG. 20. The horizontal axis represents frequencies in the range of 0-20 GHz for signals of the differential signal pair S1, S2. In this respect, it is noted that the electrical connectors of the present invention, in particular, may be applied in the transmission of binary signals (e.g., at bit rates exceeding 10 Gbit/s) and a single bit pulse of such a binary signal is represented by a series of waves with frequencies comprising substantially the entire frequency range of FIG. 18. The vertical axis represents the insertion loss of the differential signal pair S1, S2 in dB.

The insertion loss characteristic for the lead frame housing that embeds the differential signal leads S1, S2 and ground leads G1, G2 shows dips at frequencies of about 7, 12.5 and 19 GHz, as clearly shown in FIG. 20. This behavior may be undesired, although an electrical connector with such an insertion loss characteristic may be appropriate for a variety of applications.

Figure 21:
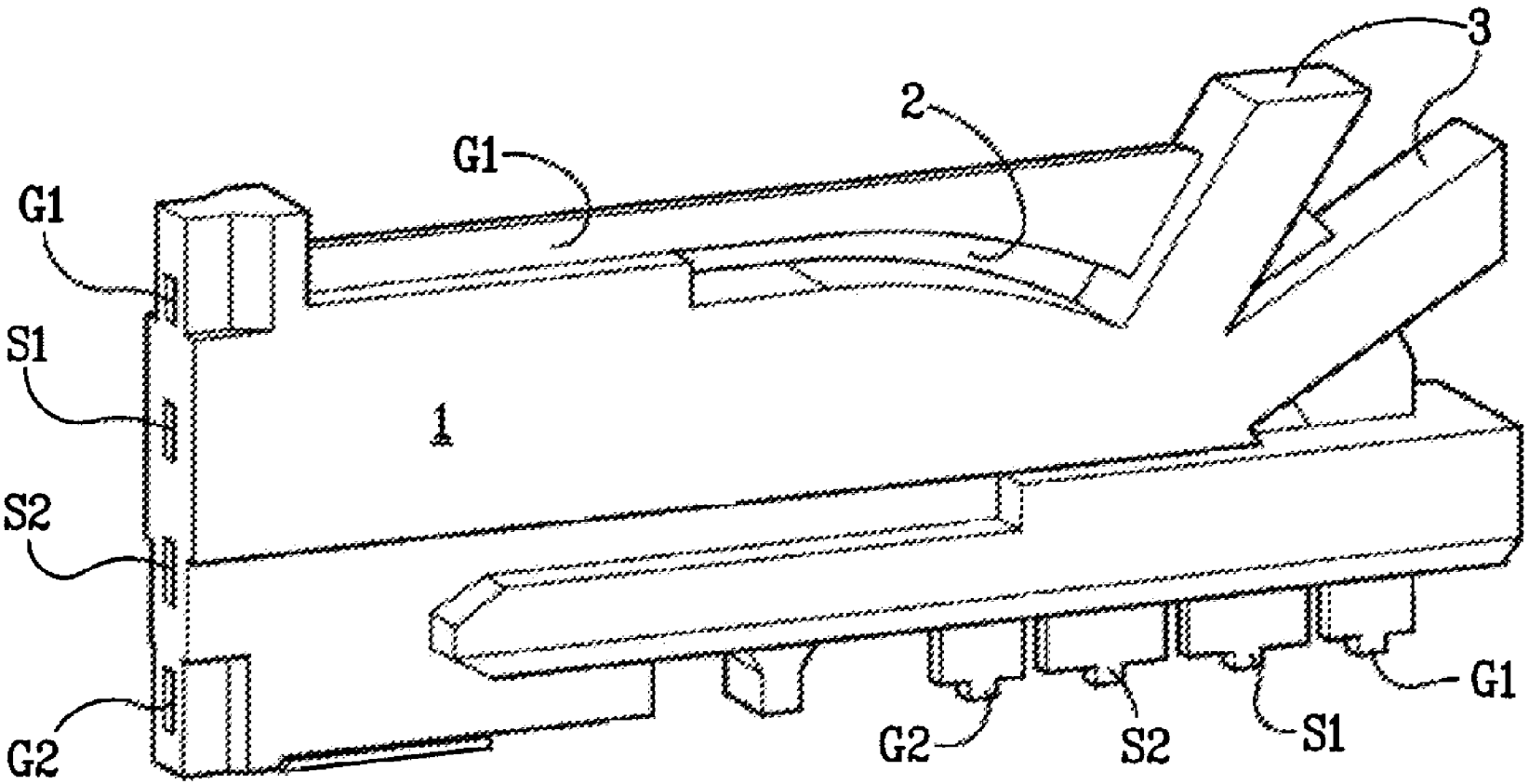
FIGS. 21-23 depict example embodiments leadframe assemblies designed for mitigation of insertion loss.
Figure 22:
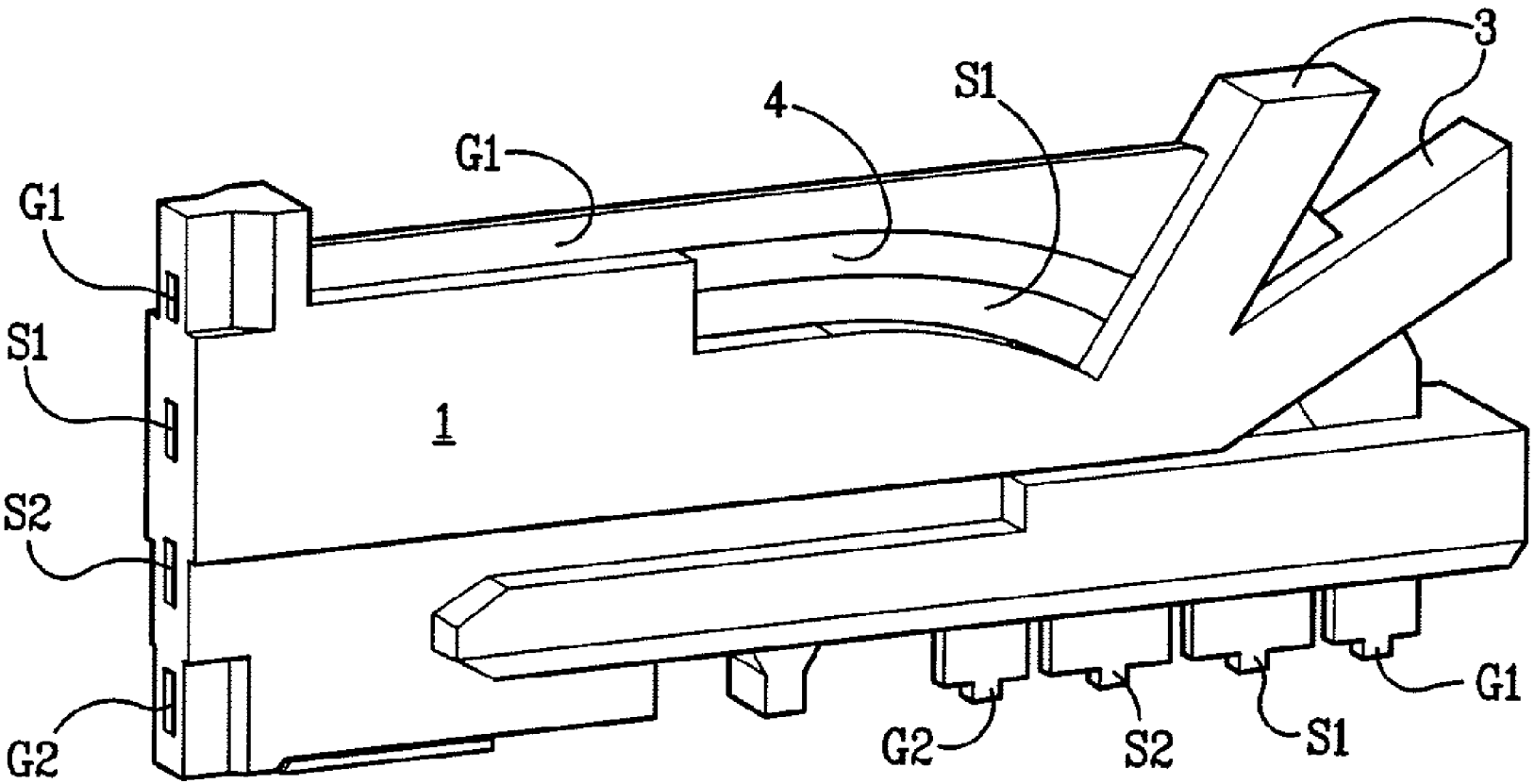
Figure 23:
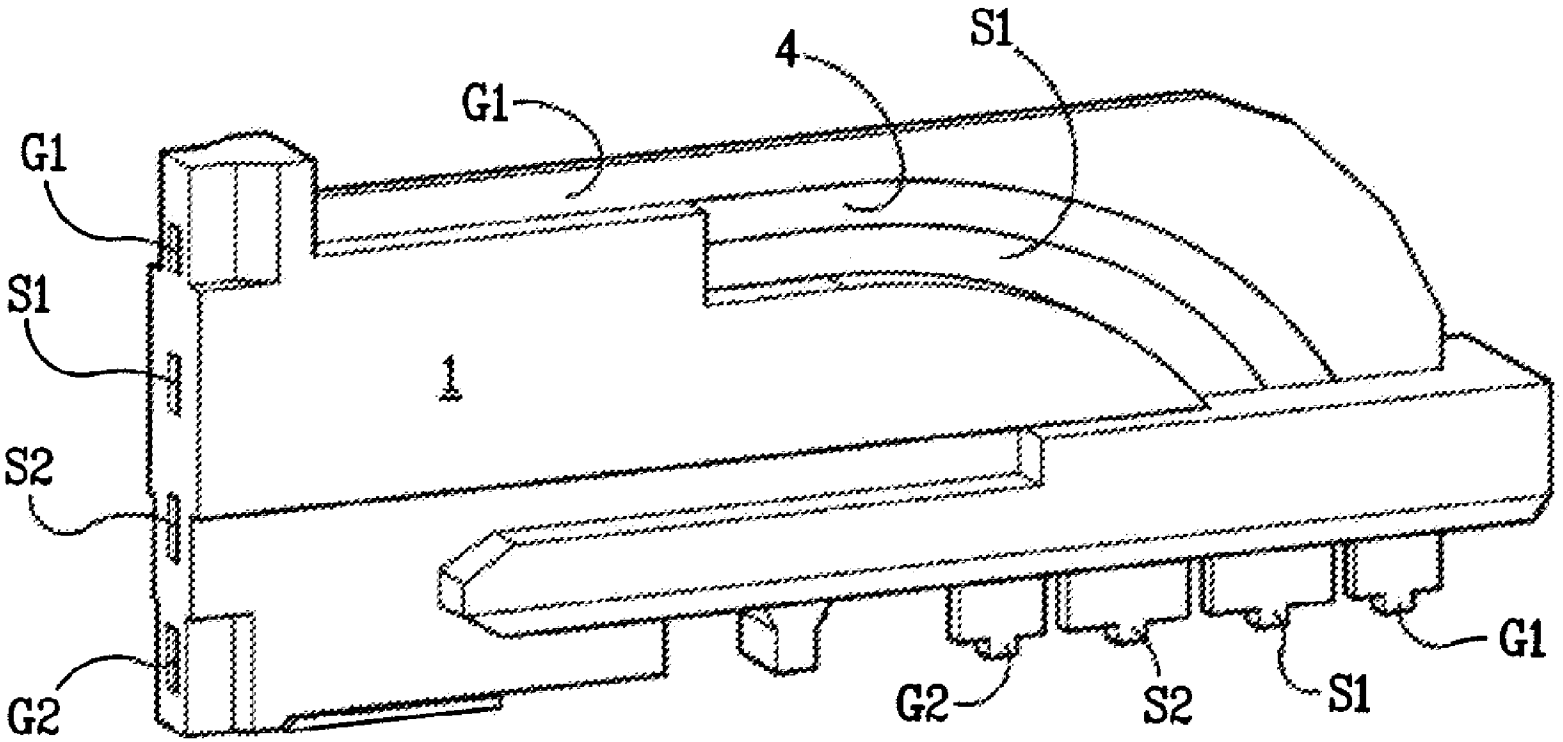

Embodiments depicted in FIGS. 21-23 provide examples for mitigation of insertion loss characteristic of FIG. 20. The labels in FIG. 20 reference FIGS. 21-23 and indicate insertion loss characteristics of the embodiments shown in the referenced figures.

In the embodiment of FIG. 21, the first ground lead G1 and second ground lead G2 may define a plane, and the lead frame housing 1 further supports a pair of differential signal leads S1, S2 located between the first ground lead G1 and second ground lead G2 in the plane. The lead frame housing 1 defines an air gap 2 between the signal lead S1 and the first ground lead G1 along a substantial portion of the physical length of the first signal lead S1. The air gap 2 is provided by selectively removing a portion of the plastic material of the lead frame housing 1 as compared to the lead frame housing 1 of FIG. 18. Support structures 3 provide adequate suspension of the first ground lead G1 in the air dielectric medium. Consequently, the electrical lengths of the first and second ground leads substantially match, and the coupling of signals from the pair of differential signal leads S1, S2 to the first ground lead G1 is reduced. The effect of the modification of the structure of the lead frame housing 1 on the insertion loss characteristic is shown in FIG. 20. The increase and dips in the insertion loss characteristic for the embodiment of FIG. 21 may be less pronounced than for the lead frame housing of FIG. 18.

In the embodiment of FIG. 22, the first ground lead G1 and second ground lead G2 again may define a plane and the lead frame housing 1 further supports a pair of differential signal leads S1, S2 located between the first ground lead G1 and the second ground lead G2 in this plane. The lead frame housing 1 comprises support structures 3 and a support portion 4 in said plane between the signal lead S1 and the first ground lead G1 along a substantial portion of the physical length of the first signal lead S1. The support portion 4 omits the need for providing the air gap 2 and eases manufacturing of the lead frame housing 1. However, an air gap 4 can also be used in place of flash or support portion 4. The sides of first ground lead G1 parallel to the above-mentioned plane, as well as the top surface, are still exposed to air as the dielectric medium. In order to compensate for the loss of air as a dielectric medium in the area of the support portion 4, a larger portion of the lead frame housing 1 is removed, such that a portion of the signal lead S1 is exposed to air. Consequently, the electrical lengths of the first and second ground leads G1, G2 may substantially match, and the coupling of signals from the pair of differential signal leads S1, S2 to the first ground lead G1 may be reduced. The effect of the modification of the structure of the lead frame housing 1 on the insertion loss characteristic is shown in FIG. 20. The increase and dips in the insertion loss characteristic for the embodiment of FIG. 22 may be less pronounced than for the lead frame housing of FIG. 18.

The embodiment of the invention as depicted in FIG. 23 may be identical to the embodiment of the invention FIG. 22, apart from the removal of the support structures 3. The support structures 3 may be superfluous as a result of the support portion 4 between the signal lead S1 and the first ground lead G1. Consequently, the electrical lengths of the first and second ground leads G1, G2 may substantially match, and the coupling of signals from the pair of differential signal leads S1, S2 to the first ground lead G1 is reduced. The effect of the modification of the structure of the lead frame housing 1 on the insertion loss characteristic is shown in FIG. 20. The increase and dips in the insertion loss characteristic for the embodiment of FIG. 23 may be less pronounced than for the lead frame housing of FIG. 18, and show also an improvement over the insertion loss characteristics of the embodiments of the invention of FIGS. 21 and 22.

It should be understood that the dielectric medium to be combined with the first physical length to obtain the first electrical length is not necessarily air. Any dielectric medium with a dielectric constant that is lower than the dielectric constant of the lead frame housing 1 may be used. In another embodiment of the invention, the lead frame housing 1 may carry a single signal lead between each two ground leads G1, G2.

Figure 24A:
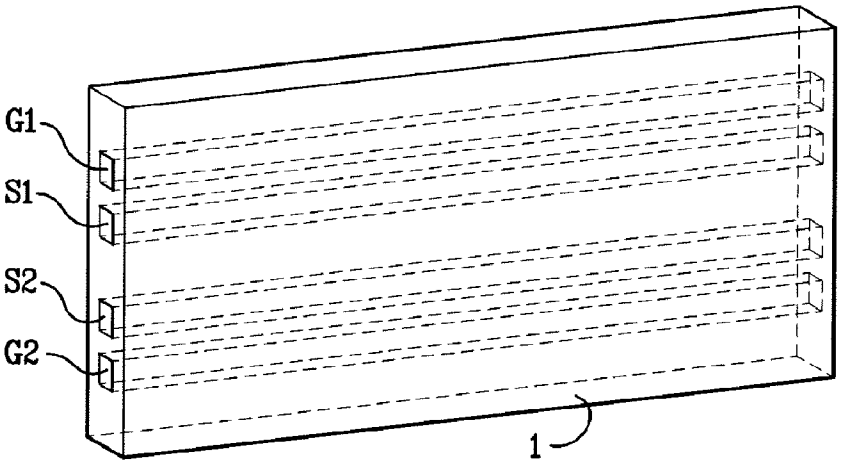
FIGS. 24A and 24B depict example embodiments of lead frame housings.
Figure 25:
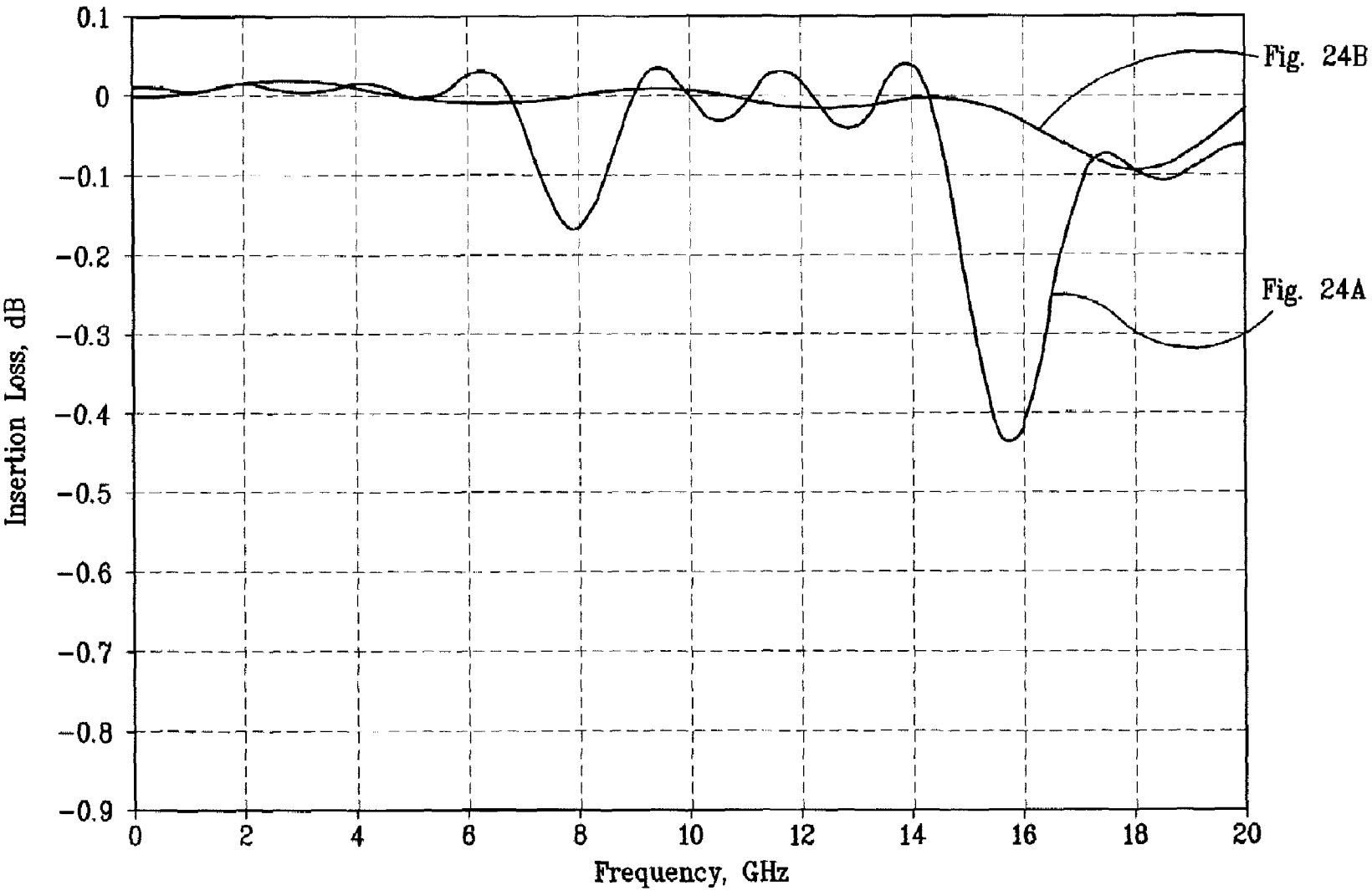
FIG. 25 is a plot of insertion loss as a function of frequency.

FIG. 24A shows a lead frame housing 1 comprising a first ground lead G1, a first signal lead S1, a second signal lead S2 and a second ground lead G2. Although the ground leads G1, G2 and signal leads S1, S2 are all fully accommodated in the lead frame housing 1 (i.e., the electrical lengths of the signal and ground leads match), the insertion loss characteristic still shows increases of the insertion loss at particular frequencies, as indicated in FIG. 25. It should be noted, however, that the increase of the insertion loss in this situation is much less pronounced than in the insertion loss characteristics of FIG. 20.

Figure 24B:
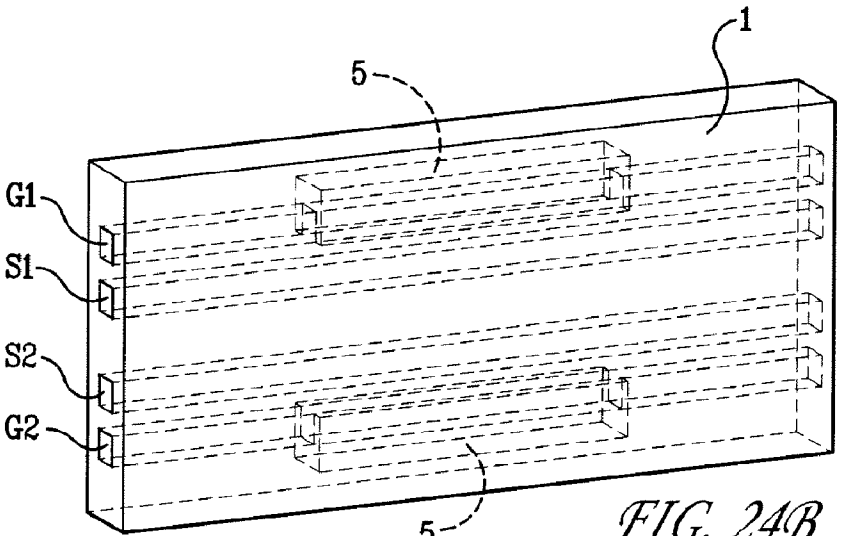

FIG. 24B shows a lead frame housing 1 comprising a first ground lead G1, a first signal lead S1, a second signal lead S2 and a second ground lead G2. In contrast with FIG. 24A, the lead frame housing 1 is adapted in order to influence the electrical length of the first and second ground leads G1 and G2. In particular, a portion of the first and second ground leads G1, G2 is accommodated in a dielectric medium 5 having a lower relative dielectric constant than the relative dielectric constant of the lead frame housing 1. As an example, the dielectric medium may be air. It should, however, be understood that any dielectric medium that has a lower relative dielectric constant than the relative dielectric constant of the lead frame housing 1 may be used for reduction of the electrical length of the ground leads G1, G2. Of course, alternatively, the electrical lengths of the signal leads S1, S2 may be increased. As a result, the electrical lengths of the first and second ground leads may be reduced in comparison with the electrical lengths of the first and second signal leads S1, S2. It has been found that the insertion loss characteristic is improved for such an embodiment.

It should be appreciated that the lead frame housing 1 of the embodiments of FIGS. 21-23 may be further adapted in order to arrive at an electrical connector comprising a lead frame housing 1 supporting first and second ground leads G1, G2 having an electrical length shorter than the electrical lengths of the signal leads S2, S2 in accordance with FIG. 24B, while the ratio of the first physical length of the ground lead G1 to the second physical length of the second ground lead G2 is greater than the ratio of the first electrical length of the first ground lead G1 to the second electrical length of the second ground lead G2. As an example, a considerable portion of the first physical length of the first ground lead G1 may be suspended in air as a dielectric medium with a relative dielectric constant that is smaller than that of the material of the lead frame housing 1, whereas also a smaller portion of the second physical length of the second ground lead G2 is exposed to air as a dielectric medium, while leaving the first and second physical lengths of the signal leads S1, S2 substantially within the dielectric material of the lead frame housing 1.

It should be understood that embodiments described herein pertain to right angle connectors but that alternative embodiments are envisioned in other types of connectors where matching ground skew, electrical lengths, electrical distances, or impedance of ground references is desired. Additionally, it should be understood that, while lowering the dielectric constant abutting the longer conductor or references at bends is described herein, alternative embodiments are envisioned where increasing the dielectric constant abutting short conductors or references at bends may be a method for matching electrical distances or electrical lengths. Additionally in such cases, decreasing the cross-sectional area of conductors extending into or through such dielectric materials may be a method for matching or providing uniform impedances of the conductors. It should also be recognized that embodiments are envisioned in co-planar waveguide structures containing a plurality of signal conductors or a plurality of differential signal pairs.

The foregoing illustrative embodiments have been provided merely for the purpose of explanation and are in no way to be construed as limiting of the invention. Words which have been used herein are words of description and illustration, rather than words of limitation. Additionally, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. An electrical connector, comprising:

a first dielectric material;

a first ground reference extending a first reference length from a first point to a second point in the first dielectric material, the first reference length comprising a first electrical length; and a second ground reference extending a second reference length from a third point to a fourth point in the first dielectric material, the second reference length comprising a second electrical length that is matched to the first electrical length, wherein the second reference length is different from the first reference length.

2. The electrical connector of claim 1, further comprising:

a second dielectric material abutting at least one portion of the first ground reference between the first and second points.

3. The electrical connector of claim 2, wherein the first dielectric material defines at least one pocket, and the at least one portion of the first ground reference abuts the second dielectric material in the pocket.

4. The electrical connector of claim 3, wherein the first dielectric material surrounds a second portion of the first ground reference, wherein the at least one portion defines, in cross section, a first area, the second portion defines, in cross section, a second area, and wherein the first area is larger than the second area.

5. The electrical connector of claim 3, wherein the second dielectric material surrounds the at least one portion.

6. The electrical connector of claim 2, wherein the first and second dielectric materials define respective first and second dielectric constants, and wherein the first dielectric constant is greater than the second dielectric constant, and wherein the first reference length is greater than the second reference length.

7. The electrical connector of claim 2, wherein the second dielectric material comprises air.

8. The electrical connector of claim 2, wherein the at least one portion of the first ground reference bends.

9. The electrical connector of claim 1, wherein each of the first and second ground references define an impedance that is uniform over the respective first and second reference lengths.

10. The electrical connector of claim 2, wherein the first and second dielectric materials define respective first and second dielectric constants, and wherein the first dielectric constant is greater than the second dielectric constant, and wherein the second reference length is greater than the first reference length.

11. The electrical connector of claim 1, wherein the first and second ground references comprise respective ground contacts.

12. The electrical connector of claim 1, wherein the first ground reference comprises a first ground contact and wherein the second ground reference comprises a virtual ground.

13. The electrical connector of claim 12, wherein the second reference length is greater than the first reference length.

14. The electrical connector of claim 12, wherein the first and second ground references are coplanar.

15. An electrical connector, comprising:

a lead frame housing comprising first and second dielectric materials; and a first ground reference extending a first length in the first dielectric material, the first length comprising a first electrical distance; and a second ground reference extending a second length in the second dielectric material, the second length different from the first length, wherein the lead frame housing defines a pocket in the first dielectric material and the second dielectric material fills the pocket, and wherein the first ground reference extends through the pocket.

16. The electrical connector of claim 15, wherein the second length comprises a second electrical distance that is matched to the first electrical distance.

17. The electrical connector of claim 15, further comprising:

a signal contact extending in the lead frame housing, wherein the first and second ground references and the signal contact define a plane.

18. An electrical connector, comprising:

a first dielectric material;

a first ground reference extending a first reference length from a first point to a second point in the first dielectric material, the first reference length comprising a first electrical length; and a second ground reference extending a second reference length from a third point to a fourth point in the first dielectric material, the second reference length comprising a second electrical length, wherein a ratio of the first reference length to the second reference length is greater than a ratio of the first electrical length to the second electrical length.

19. The system of claim 18, wherein the first electrical length is matched to the second electrical length.

20. The system of claim 18, wherein each of the first and second ground references define an impedance that is uniform over the respective first and second reference lengths.

* * * * *